US005210011A

United States Patent [19]

Tsukahara et al.

[11] Patent Number: 5,210,011

[45] Date of Patent: May 11, 1993

[54] SILVER HALIDE PHOTOGRAPHIC PHOTOSENSITIVE MATERIAL CONTAINING TWO TYPES OF CYAN DYE FORMING COUPLERS

[75] Inventors: Jiro Tsukahara; Hidetoshi Kobayashi, both of Kanagawa, Japan

[73] Assignee: Fuji Photo Film Co., Ltd., Kanagawa, Japan

[21] Appl. No.: 625,481

[22] Filed: Dec. 11, 1990

[30] Foreign Application Priority Data

Dec. 15, 1989 [JP] Japan ..... 1-325012

[51] Int. Cl.[5] ..... G03C 7/34

[52] U.S. Cl. ..... 430/549; 430/552; 430/553

[58] Field of Search ..... 430/549, 552, 553

[56] References Cited

U.S. PATENT DOCUMENTS

| | | | |
|---|---|---|---|
| 4,333,999 | 6/1982 | Lau | 430/17 |
| 4,594,314 | 6/1986 | Kimura et al. | 430/506 |
| 4,690,889 | 9/1987 | Saito et al. | 430/552 |
| 4,883,746 | 11/1989 | Shimada et al. | 430/549 |

FOREIGN PATENT DOCUMENTS

| | | | |
|---|---|---|---|
| 0102821 | 4/1987 | European Pat. Off. . | |
| 0296854 | 12/1988 | European Pat. Off. | 430/549 |
| 59-46644 | 3/1984 | Japan . | |
| 62-75444 | 7/1987 | Japan | 430/549 |

*Primary Examiner*—Lee C. Wright

*Attorney, Agent, or Firm*—Birch, Stewart, Kolasch & Birch

[57] ABSTRACT

A silver halide color photographic photosensitive material comprising a support having thereon a at least one silver halide emulsion layer, wherein at least one cyan dye forming coupler represented by the formula (I) indicated below wherein all the symbols are defined in the specification and at least one cyan dye forming coupler which can be represented by the formula (C) indicated below wherein all the symbols are defined in the specification are present in a layer on said support.

18 Claims, No Drawings

SILVER HALIDE PHOTOGRAPHIC PHOTOSENSITIVE MATERIAL CONTAINING TWO TYPES OF CYAN DYE FORMING COUPLERS

FIELD OF THE INVENTION

This invention concerns silver halide color photographic photosensitive materials which contain novel phenol type cyan dye forming couplers.

BACKGROUND OF THE INVENTION

Colored images are formed by the reaction of dye forming couplers (referred to hereinafter as "couplers") with primary aromatic amine developing agents which have been oxidized by color development after the silver halide photographic photosensitive material has been imagewise exposed. In general, yellow, magenta and cyan colored images which have a complementary color relationship are used to reproduce blue, green and red colors using the subtractive method of color reproduction. Phenol derivatives or naphthol derivatives are often used as couplers for forming the cyan image. In color photography, the color forming couplers may be added to the developer or they may be incorporated in a photosensitive emulsion layer or another color image forming layer, and a non-diffusible dye is formed by reaction with the oxidized form of a color developing agent which is formed by development.

The reaction between the coupler and the color developing agent occurs at the active site of the coupler. Couplers which have a hydrogen atom at the active site are four equivalent couplers, which is to say, stoichiometrically, they require 4 mol of silver halide with development nuclei in order to form 1 mol of dye. On the other hand, couplers which have a group which can be eliminated as an anion at the active site are two equivalent couplers, which is to say these couplers only require stoichiometrically 2 mol of silver halide which has development nuclei to form 1 mol of dye. Thus, the amount of silver halide in the photosensitive material can generally be reduced and the film thickness can be reduced relative to that of a four equivalent coupler, the processing time for the photosensitive material can be shortened and the sharpness of the colored image which is formed is also improved.

Of these cyan couplers, the absorption of the dye which is formed using naphthol type couplers is at a sufficiently long wavelength and there is little overlap with the absorption of the magenta dye image. Moreover, since these couplers have a low to a high coupling activity with the oxidized form of a color developing agent they are widely used in photographic applications centered around color negative films. However, the dye images obtained from naphthol type couplers are reduced by ferrous ions which accumulate in fatigued bleach baths and bleach-fix baths and tend to fade (this is known as "reduction fading") and the fastness of the image to heat is poor. As a result, there is a great demand for improvement.

On the other hand, phenol type cyan couplers which have a p-cyanophenylureido group in the 2-position and a carbonamido group which is a ballast group (a group which renders the molecule resistant to diffusion) in the 5-position are disclosed in U.S. Pat. No. 4,333,999. The dye formed using these couplers has a deep color shifted by association in the film and they provide colored images which have an excellent hue and provide excellent fastness. As a result, they are now being used widely as couplers to replace the above-described naphthol type cyan couplers.

However, although the dyes formed from phenol type couplers which have a ureido group in the 2-position provide a desirable hue in the high density areas, the peak absorption wavelength ($\lambda_{max}$) deviates to the short wavelength side in the low density areas and there is the disadvantage in that color reproduction is adversely affected. The combined use of 1-naphthol couplers with the above phenol type couplers is disclosed in JP-A-59-46644 and the combined use of a 5-amido-1-naphthol coupler with the above phenol type couplers is disclosed in JP-A-62-75444 as methods of overcoming this problem. (The term "JP-A" as used herein signifies an "unexamined published Japanese patent application").

However, the demands for photographic photosensitive materials have become more severe recently and the demand for higher coupling reactivity and higher dye absorption densities have continued.

SUMMARY OF THE INVENTION

Hence, an object of the present invention is to provide silver halide color photosensitive materials which provide a high coupling reactivity and a high dye absorption density in which the dye formed has a preferred hue in both the low density regions and the high density regions.

As a result of thorough research to achieve the above-described objective, the inventors have discovered that the objective can be achieved by means of a silver halide color photosensitive material described below.

This is to say, the present invention provides a silver halide color photographic photosensitive material comprising a support having thereon a photographic layer which contains at least one silver halide emulsion layer wherein at least one cyan dye forming coupler represented by the formula (I) indicated below

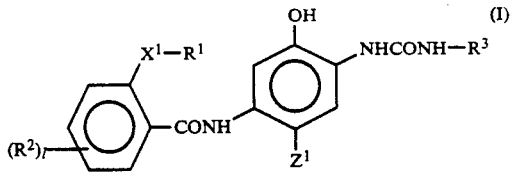

wherein $R^1$ represents a substituted or unsubstituted alkyl group, alkenyl group, alkynyl group, cycloalkyl group or aryl group, $X^1$ represents a single bond, —O—, —S—, —SO—, —$SO_2$—, —COO—, $$-\underset{\underset{R^6}{|}}{CON}-,\ -SO_2O-,\ -\underset{\underset{R^6}{|}}{SO_2N}-\ \text{or}\ -\underset{\underset{R^7}{|}}{N}-,$$

$R^2$ represents a group which can be substituted on a benzene ring, L represents an integer of from 0 to 4, $R^3$ represents a substituted or unsubstituted aryl group and $Z^1$ represents a hydrogen atom or a coupling-off group and at least one cyan dye forming coupler represented by the formula (C) indicated below

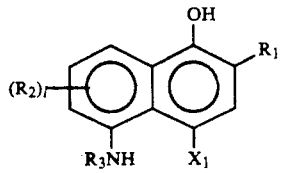

(C)

wherein $R_1$ represents $—CONR_4R_5$, $—SO_2NR_4R_5$, $—NHCOR_4$, $—NHCOOR_6$, $—NHSO_2R_6$, $—NHCONR_4R_5$, or $—NHSO_2NR_4R_5$, $R_2$ represents a group which can be substituted on a naphthalene ring, l represents an integer of from 0 to 3, $R_3$ represents a substituent group, and $X_1$ represents a hydrogen atom or a coupling-off group; $R_4$ and $R_5$ may be the same or different, each represents a hydrogen atom, an alkyl group, an aryl group or a heterocyclic group, and $R_6$ represents an alkyl group, an aryl group or a heterocyclic group, when represents 2 or 3, the $R_2$ groups may be the same or different, or they may combine and form a ring; $R_2$ and $R_3$, or $R_3$ and $X_1$, may combine and form a ring; dimers or larger oligomers may be formed by joining together via divalent groups or groups of a valency greater than two in $R_1$, $R_2$, $R_3$ or $X_1$ are present in the photographic layer.

DETAILED DESCRIPTION OF THE INVENTION

In formulae (I) and (C) described above, the alkyl group may be a linear chain branched chain or cyclic alkyl group, it may have unsaturated bonds, and it may have substituent groups (for example, halogen atoms, hydroxyl groups, aryl groups, heterocyclic group, alkoxy groups, aryloxy group, alkylsulfonyl groups, arylsulfonyl groups, alkoxycarbonyl groups, acyloxy groups, acyl groups). Typical examples include methyl, iso-propyl, iso-butyl, tert-butyl, 2-ethylhexyl, cyclohexyl, n-dodecyl, n-hexadecyl, 2-methoxyethyl, benzyl, trifluoromethyl, 3-dodecyloxypropyl and 3-(2,4-di-tert-butylphenoxy)propyl.

Furthermore, the aryl groups in the formulae (I) and (C) may be condensed rings (for example, naphthyl groups), and they may have substituent groups (for example, halogen atoms, alkyl groups, aryl groups, alkoxy groups, aryloxy groups, cyano groups, acyl groups, alkoxycarbonyl group, carbonamido groups, sulfonamido groups, carbamoyl groups, sulfamoyl groups, alkylsulfonyl groups, arylsulfonyl groups). Typical examples include phenyl, tolyl, pentafluorophenyl, 2-chlorophenyl, 4-hydroxyphenyl, 4-cyanophenyl, 2-tetradecyloxyphenyl, 2-chloro-5-dodecyloxyphenyl and 4-tert-butylphenyl.

Furthermore, the heterocyclic groups are three to eight membered single or condensed ring heterocyclic groups which have at least one O, N, S, P, Se or Te hetero-atom in the ring and they may have substituent groups (for example, halogen atoms, carboxyl groups, hydroxyl groups, nitro groups, alkyl groups, aryl groups, alkoxy groups, aryloxy groups, alkoxycarbonyl groups, aryloxycarbonyl groups, amino groups, carbamoyl groups, sulfamoyl groups, alkylsulfonyl groups, arylsulfonyl groups). Typical examples include 2-pyridyl, 4-pyridyl, 2-furyl, 4-thienyl, benzotriazol-1-yl, 5-phenyltetrazol-1-yl, 5-methylthio-1,3,4-thiadiazol-2-yl and 5-methyl-1,3,4-oxadiazol-2-yl.

Cyan dye forming couplers represented by formula (I) are described in detail below.

In formula (I), $R^1$ preferably represents a linear chain or branched chain alkyl group which has a total number of carbon atoms (referred to hereinafter as the C number) of from 1 to 36 (and most preferably of from 6 to 24), a linear chain or branched chain alkenyl of C number from 2 to 36 (and most preferably of from 6 to 24), a linear chain or branched chain alkynyl group of C number from 2 to 36 (and most preferably of from 6 to 24), a three to twelve membered cycloalkyl group of C number from 3 to 36 (and most preferably of from 6 to 24) or an aryl group of C number from 6 to 36 (and most preferably of from 6 to 24), and these groups may be substituted with substituent groups (for example, halogen atoms, hydroxyl groups, carboxyl groups, sulfo groups, cyano groups, nitro groups, amino groups, alkyl groups, alkenyl groups, alkynyl groups, cycloalkyl groups, aryl groups, alkoxy groups, aryloxy groups, alkylthio groups, arylthio groups, alkylsulfonyl groups, arylsulfonyl groups, acyl groups, acyloxy groups, alkoxycarbonyl groups, aryloxycarbonyl groups, carboxamido groups, sulfonamido groups, carbamoyl groups, sulfamoyl group, ureido groups, alkoxycarbonylamino groups, sulfamoylamino groups, alkoxysulfonyl groups, imido groups or heterocyclic groups, these substituent groups being referred to as group A substituent groups). $R^1$ is preferably a linear chain or branched chain unsubstituted alkyl group or an alkyl group which has substituent groups (alkoxy groups, alkylthio group, aryloxy groups, arylthio groups, alkylsulfonyl groups, arylsulfonyl groups, aryl groups, alkoxycarbonyl groups, epoxy groups, cyano groups or halogen atoms) [for example, n-octyl, n-decyl, n-dodecyl, n-hexadecyl, 2-ethylhexyl, 3,5,5-trimethylhexyl, 2-ethyl-4-methylpentyl, 2-decyl, 2-hexyldecyl, 2-heptylundecyl, 2-octyldodecyl, 2,4,6-trimethylhepthyl, 2,4,6,8-tetramethylnonyl, benzyl, 2-phenethyl, 3-(t-octylphenoxy)propyl, 3-(2,4-di-tert-pentylphenoxy)propyl, 2-(4-biphenyloxy)ethyl, 3-dodecyloxypropyl, 2-dodecylthioethyl, 9,10-epoxyoctadecyl, dodecyloxycarbonylmethyl, 2-(2-naphthyloxy)ethyl], a unsubstituted alkenyl group or an alkenyl group which has substituent groups (for example, halogen atoms, aryl groups, alkoxy groups, alkylthio groups, aryloxy groups, arylthio groups or alkoxycarbonyl groups) [for example, allyl, 10-undecenyl, oleyl, citronellyl, cinnamyl], an unsubstituted cycloalkyl group or a cycloalkyl group which has substituent groups (for example, halogen atoms, alkyl groups, alkoxy groups or aryloxy groups) [for example, cyclopentyl, cyclohexyl, 3,5-dimethylcyclohexyl, 4-tert-butylcyclohexyl], or an unsubstituted aryl group or an aryl group which has substituent groups (for example, halogen atoms, alkyl groups, alkoxy groups, alkoxycarbonyl groups, aryl groups, carbonamido groups, alkylthio groups or sulfonamido groups) [for example, phenyl, 4-dodecyloxyphenyl, 4-biphenyl, 4-dodecanesulfonamidophenyl, 4-tert-octylphenyl, 3-pentadecylphenyl], and it is most desirably one of the above-described linear chain, branched chain or substituted alkyl groups.

In formula (I), $X_1$ represents a single bond, —O—, —S—, —SO—, $—SO_2—$, —COO—, $$—\underset{\underset{R^6}{|}}{CON}—,\ —SO_2O—,\ —\underset{\underset{R^6}{|}}{SO_2N}—\ \text{or}\ —\underset{\underset{R^7}{|}}{N}—.$$

Here, $R^6$ represents a hydrogen atom, an acyl group of C number from 1 to 36 (and preferably of C number from 2 to 24) (for example, acetamido, butanamido, benzamido, dodecanamido, methylsulfonyl, p-tolylsulfonyl, dodecylsulfonyl, 4-methoxyphenylsulfonyl) or a group with the same meaning as $R^1$, and it is preferably a hydrogen atom, a linear, branched or substituted alkyl group or a substituted or unsubstituted aryl group. $R^7$ is a hydrogen atom or a linear chain, branched chain or substituted alkyl group. The —COO—, $$-\underset{\underset{R^6}{|}}{CON}-,\ -SO_2O-\ \text{and}\ -\underset{\underset{R^6}{|}}{SO_2N}-$$

in $X^1$ may be bonded to $R^1$ by either of the above bond. $X^1$ is preferably —O—, —S—, —$SO_2$—, or —COO— (bonded to $R^1$ through an O atom), and it is most desirably —O— or —COO— (bonded to $R^1$ through an O atom).

$R^2$ in formula (I) is a group which can be substituted on a benzene ring, and it is preferably a group selected from among the above-described group of A substituent groups, and when l is 2 or more the $R^2$ groups may be the same or different. $R^2$ is most preferably a halogen atom (F, Cl, Br, I), an alkyl group of C number from 1 to 24 (for example, methyl, butyl, tert-butyl, tert-octyl, 2-dodecyl), a cycloalkyl group of C number from 3 to 24 (for example, cyclopentyl, cyclohexyl), an alkoxy group of C number from 1 to 24 (for example, methoxy, butoxy, dedecyloxy, benzyloxy, 2-ethylhexyloxy, 3-dodecyloxypropoxy, 2-dodecylthioethoxy, dodecyloxycarbonylmethoxy), a carbonamido group of C number from 2 to 24 (for example, acetamido, 2-ethylhexanamido, trifluoroacetamido) or a sulfonamido group of C number from 1 to 24 (for example, methanesulfonamido), dodecanesulfonamido, toluenesulfonamido).

Moreover, l in formula (I) is preferably an integer of from 0 to 2, and most preferably l is 0 or 1.

$R^3$ in formula (I) preferably represents an aryl group of C number from 6 to 36, and most preferably of from 6 to 15. This aryl group may be substituted with substituent groups selected from the group of A substituent groups, and it may be a condensed ring. Preferred substituent groups are halogen atoms (F, Cl, Br, I), cyan group, nitro group, acyl groups (for example, acetyl, benzoyl), alkyl groups (for example, methyl, tert-butyl, trifluoromethyl, trichloromethyl), alkoxy groups (for example, methoxy, ethoxy, butoxy trifluoromethoxy), alkylsulfonyl groups (for example, methylsulfonyl, propylsulfonyl, butylsulfonyl, benzylsulfonyl), arylsulfonyl groups (for example, phenylsulfonyl, p-tolylsulfonyl, p-chlorophenylsulfonyl), alkoxycarbonyl groups (for example, methoxycarbonyl, butoxycarbonyl), sulfonamido groups (for example, methanesulfonamido, trifluoromethanesulfonamido, toluenesulfonamido), carbamoyl groups (for example, N,N-dimethylcarbamoyl, N-phenylcarbamoyl) or sulfamoyl groups (for example, N,N-diethylsulfamoyl, N-phenylsulfamoyl). $R^3$ is preferably a phenyl group which has at least one substituent selected from halogen atoms, a cyano group, a sulfonamido group, alkylsulfonyl groups, arylsulfonyl groups and a trifluoromethyl group, more preferably it is a 4-cyanophenyl, 4-cyano-3-halogenophenyl, 3-cyano-4-halogenophenyl, 4-alkylsulfonylphenyl, 4-alkylsulfonyl-3-halogenophenyl, 4-alkylsulfonyl-3-alkoxyphenyl, 3-alkoxy-4-alkylsulonylphenyl, 3,4-dihalogenophenyl, 4-halogenophenyl, 3,4,5-trihalogenophenyl, 3,4-dicyanophenyl, 3-cyano-4,5-dihalogenophenyl, 4-trifluoromethylphenyl or 3-sulfonamidophenyl group, and most preferably it is a 4-cyanophenyl, 3-cyano-4-halogenophenyl, 4-cyano-3-halogenophenyl, 3,4-dicyanophenyl or 4-alkylsulfonylphenyl group.

$Z^1$ in formula (I) represents a hydrogen atom or a coupling-off group (including a leaving atom, hereinafter the same). Preferred examples of coupling-off groups include halogen atoms, —$OR^4$, —$SR^4$, $$-\underset{\underset{O}{\|}}{CR^4}-,\ -OSO_2R^4,\ -NHCOR^4,\ -NHC\underset{\underset{O}{\|}}{S}R^4,\ -O\underset{\underset{O}{\|}}{C}OR^4,$$

$$-O\underset{\underset{O}{\|}}{C}NHR^4,$$

arylazo groups of C number from 6 to 30, and heterocyclic groups (for example, succinimido, phthalimido, hydantoinyl, pyrazolyl, 2-bensotriazolyl) which are bonded to the coupling active site (the position to which $Z^1$ is bonded) by a nitrogen atom. Here, $R^4$ represents an alkyl group of C number from 1 to 36, an alkenyl group of C number from 2 to 36, a cycloalkyl group of C number from 3 to 36, an aryl group of C number from 6 to 36 or a heterocyclic group of C number from 2 to 36, and these groups may be substituted with substituent groups selected from the group of A substituent groups, $Z^1$ is more preferably a hydrogen atom, a halogen atom, an alkoxy group, an aryloxy group or an alkylthio group, and it is most preferably a hydrogen atom, a chlorine atom, a group represented by the formula (II) indicated below or a group represented by the formula (III) indicated below.

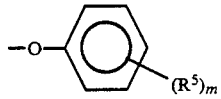

(II)

In the formula (II), $R^5$ represents a halogen atom, a cyano group, a nitro group, an alkyl group, an alkoxy group, an alkylthio group, an alkylsulfonyl group, an arylsulfonyl group, a carbonamido group, a sulfonamido group, an alkoxycarbonyl group, a carbamoyl group, a sulfamoyl group -or a carboxyl group, and m represents an integer of from 0 to 5, and when m is 2 or more the $R^5$ groups may be the same or different.

$$-O-\underset{\underset{R^9}{|}}{\overset{\overset{R^8}{|}}{(C)_n}}-Y_1-R^{10} \qquad \text{(III)}$$

In this formula, $R^8$ and $R^9$ each represents a hydrogen atom or a univalent group, $Y_1$ represents $$-\overset{\overset{O}{\|}}{C}-,\ -\overset{\overset{O}{\|}}{S}-,\ -\underset{\underset{O}{\|}}{\overset{\overset{O}{\|}}{S}}-\ \text{or}\ -\underset{\underset{R^{11}}{|}}{\overset{\overset{O}{\|}}{P}}-,$$

and $R^{10}$ and $R^{11}$ each represent a hydroxyl group, an alkyl group, an aryl group, an alkoxy group, an alkenyloxy group, an aryloxy group or a substituted or unsubstituted amino group, and n represents an integer of value from 1 to 6. Here, when n is 2 or more the

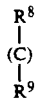

groups may be the same or different.

In formula (II), $R^5$ is preferably a halogen atom, an alkyl group (for example, methyl, tert-butyl, tert-octyl, pentadecyl), an alkoxy group (for example, methoxy, n-butoxy, -n-octyloxy, benzyloxy, methoxyethoxy), a carbonamido group (for example, acetamido, 3-carboxypropanamido) or a sulfonamido group (for example, methanesulfonamido, toluenesulfonamido, p-dodecyloxybenzenesulfonamido), and it is most preferably an alkyl group or an alkoxy group. Moreover, m is preferably an integer of from 0 to 2, and preferably 0 or 1.

When $R^8$ and/or $R^9$ in formula (III) is a univalent group, preferably an alkyl group (for example, methyl, ethyl, n-butyl, ethoxycarbonylmethyl, benzyl, n-decyl, n-dodecyl), an aryl group (for example, phenyl, 4-chlorophenyl, 4-methoxyphenyl) and acyl group (for example, acetyl, decanoyl, benzoyl, pivaloyl) or a carbamoyl group (for example, N-ethylcarbamoyl, N-phenylcarbamoyl), and $R^8$ and $R^9$ are most preferably hydrogen atoms, alkyl groups or aryl groups. Moreover, $Y_1$ in formula (III) is preferably

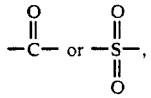

and most desirably it is

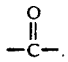

$R^{10}$ in formula (III) is preferably an alkyl group, an alkoxy group, an alkenyloxy group, an aryloxy group or a substituted or unsubstituted amino group, and it is most preferably an alkoxy group or a substituted or unsubstituted amino group.

Moreover, n is formula (III) is preferably an integer of from 1 to 3, and it is most preferably 1.

Specific examples of

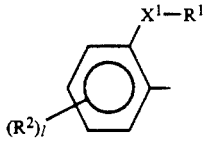

in formula (I) are shown below.

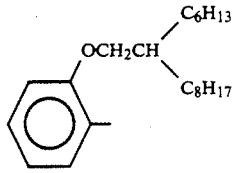

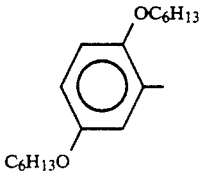

-continued

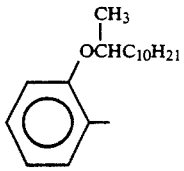

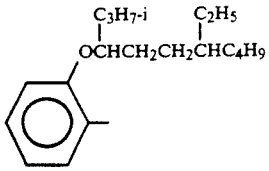

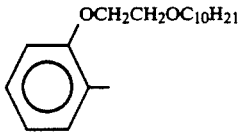

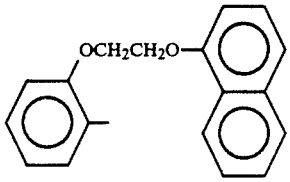

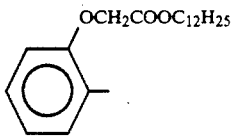

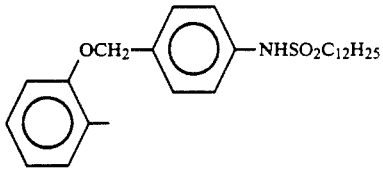

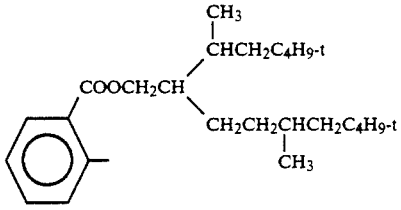

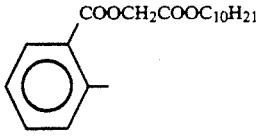

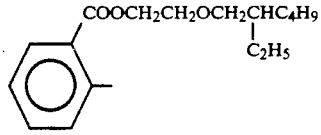

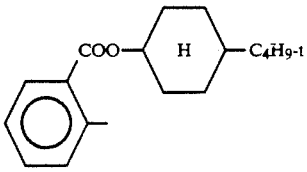

-continued
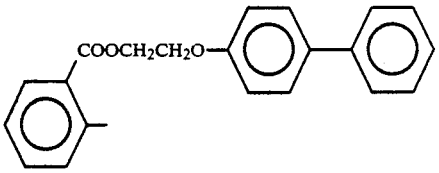
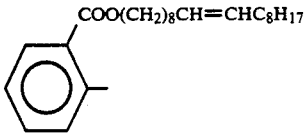
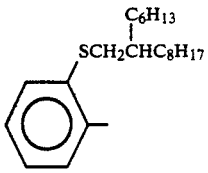
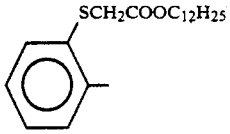
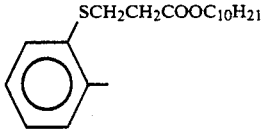
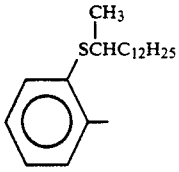
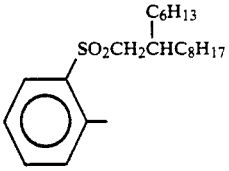
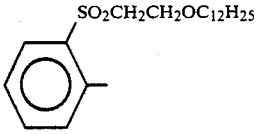
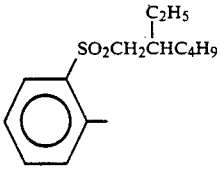
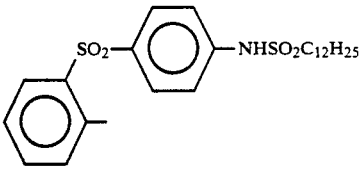
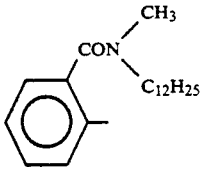
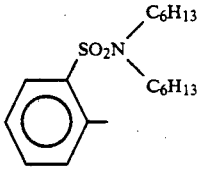
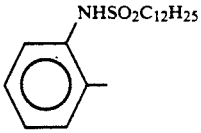
-continued
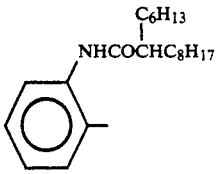
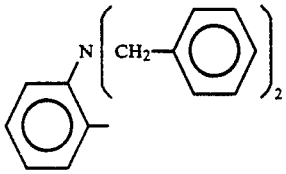
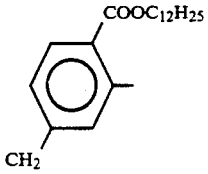
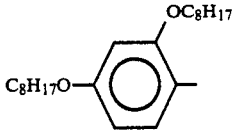
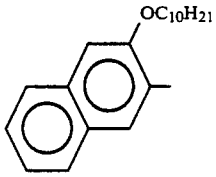
Specific examples of $R^3$ in formula (I) are shown below.
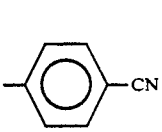
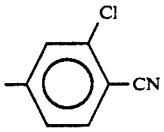
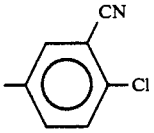
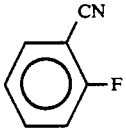
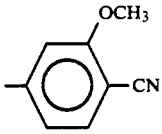
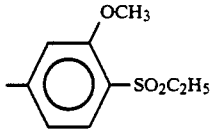
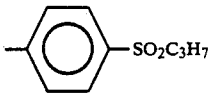
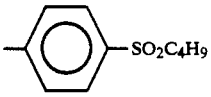
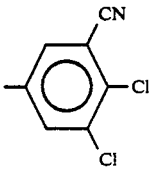
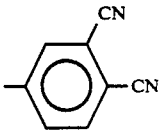

-continued
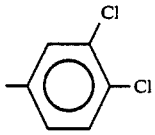
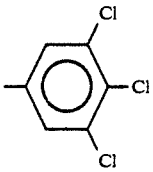
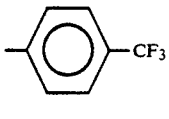
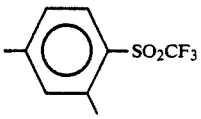
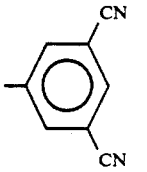
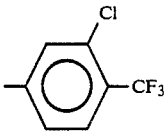
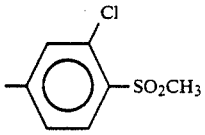
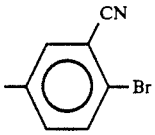
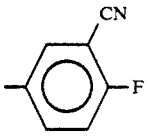
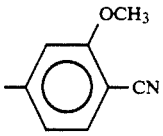
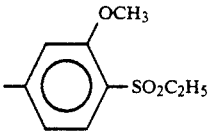
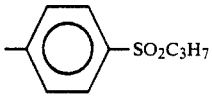
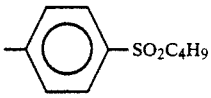
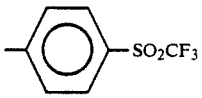
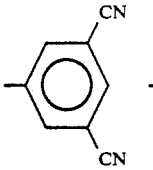
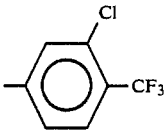
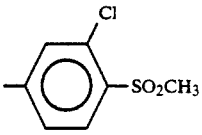
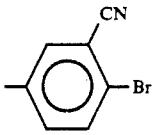
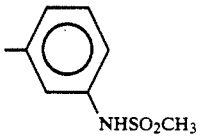
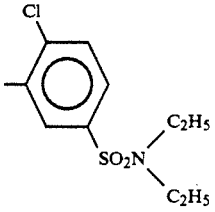
-continued
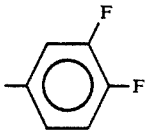
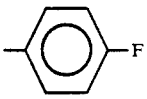
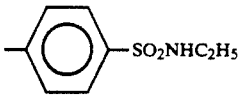
Specific examples of $Z_1$ in formula (I) are indicated below.
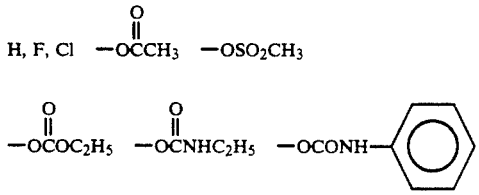
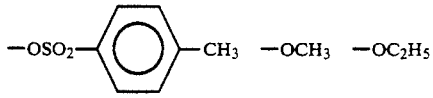
$-OCH_2CH_2OCH_3$ $-OCH_2COOCH_3$
$-OCH_2CH_2COOCH_3$ $-OCH(CH_3)COOCH_3$
$-OCH_2COOH$ $-OCH_2CH_2SO_2CH_3$
$-OCH_2CONHCH_2CH_2OH$ $-OCH_2CONHCH_2CH_2OCH_3$
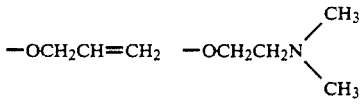
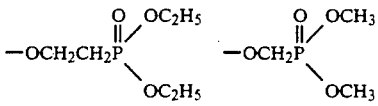
$-OCH(CH_2COOC_2H_5)COOC_2H_5$ $-OCH_2CH_2OH$
$-OCH_2CH_2SCH_2COOH$ $-OCH_2CH_2NHSO_2CH_3$
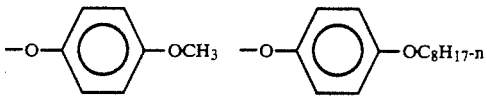
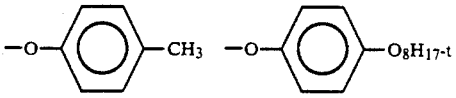
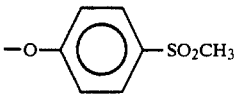

-continued

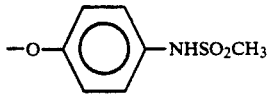

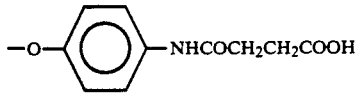

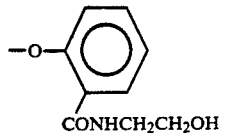

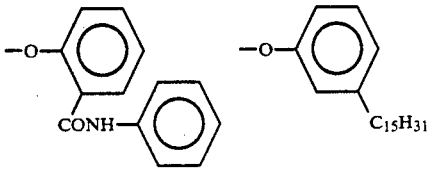

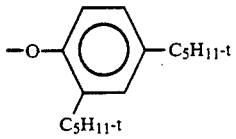

$-SCH_2COOC_2H_5$ $-SCH_2COOH$ $-SCH_2CH_2COOH$ $-SCH(CH_3)COOH$ $-SCH_2CH_2OH$ $-SCH_2CH(OH)CH_2OH$

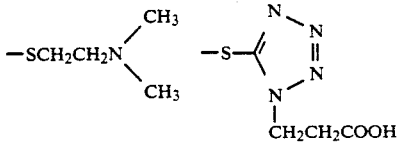

-continued

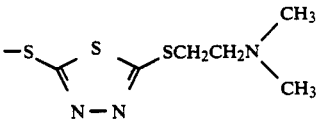

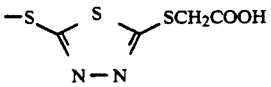

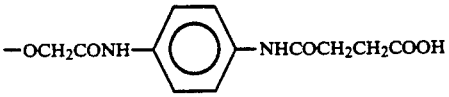

$-OCH_2COOC_4H_{9}\text{-sec}$ $-OCH_2COOC_4H_{9}\text{-t}$

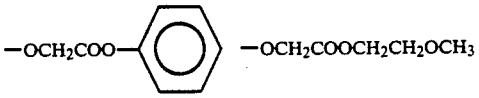

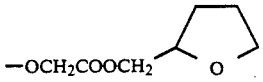

$-OCH_2COOCH_2COOC_2H_5$

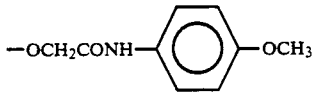

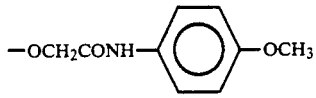

$-OCH_2COOCH_2CH_2SO_2CH_3$

Specific examples of cyan dye forming couplers represented by formula (I) are shown below but the present invention is not to be construed as being limited to these examples.

(I)

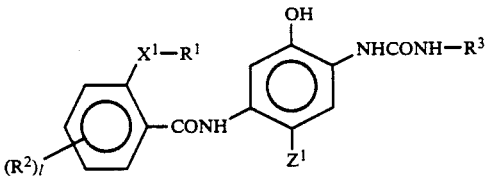

| Coupler Number | 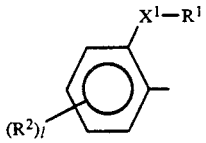 | $R^3$ | $Z^1$ |
|---|---|---|---|
| I-1 | 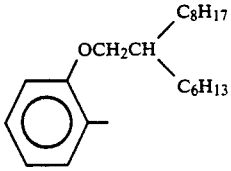 | 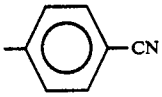 | H |

-continued
(I)
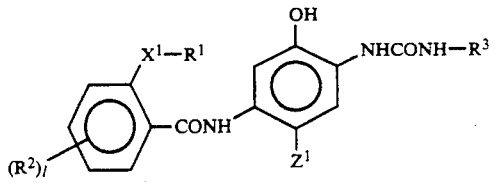
| Coupler Number | 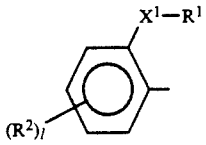 | $R^3$ | $Z^1$ |
|---|---|---|---|
| I-2 | 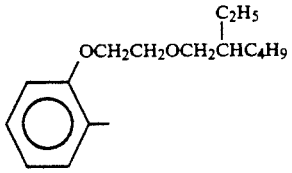 | 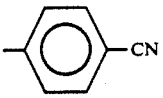 | H |
| I-3 | 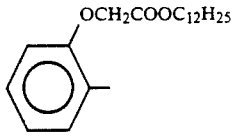 | 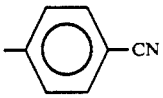 | H |
| I-4 | 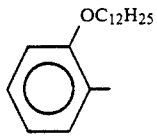 | 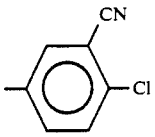 | H |
| I-5 | 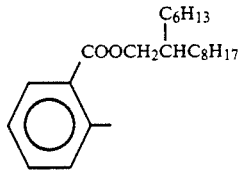 | 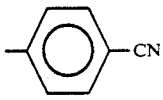 | H |
| I-6 | 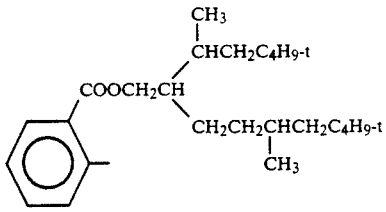 | 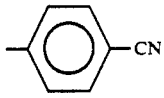 | H |
| I-7 | 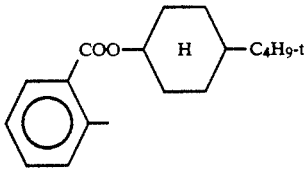 | 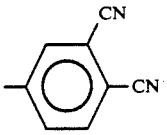 | H |
| I-8 | 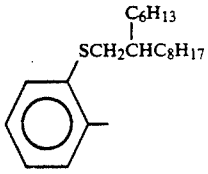 | 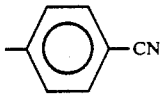 | H |

-continued
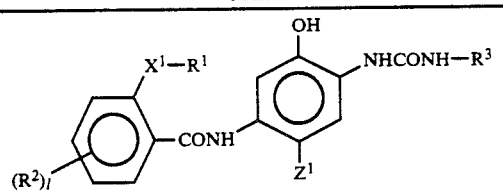
(I)
| Coupler Number | 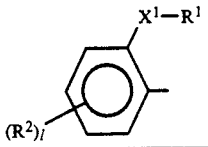 | $R^3$ | $Z^1$ |
|---|---|---|---|
| I-9 | $SCH_2COOC_{12}H_{25}$ | 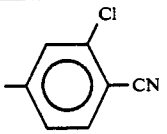 | H |
| I-10 | $SO_2CH_2CH(C_6H_{13})C_8H_{17}$ | 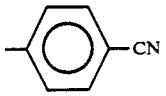 | H |
| I-11 | $SO_2CH_2CH_2OC_{12}H_{25}$ | 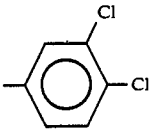 | H |
| I-12 | $CON(CH_3)-C_{12}H_{25}$ | 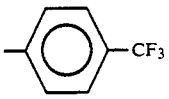 | H |
| I-13 | $NHSO_2C_{12}H_{25}$ | 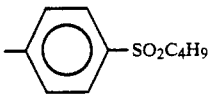 | H |
| I-14 | $NHCO(C_6H_{13})CC_8H_{17}$ | 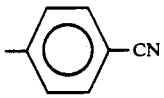 | Cl |
| I-15 | $OCH(CH_3)-C_{10}H_{21}$ | 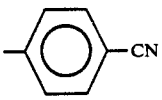 | Cl |
| I-16 | $OCH_2CH(C_2H_5)C_4H_9$ | 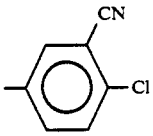 | $-OCH_2COOCH_3$ |

-continued
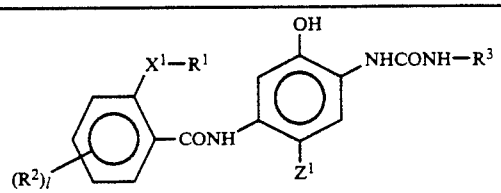
(I)
| Coupler Number | 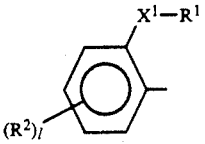 | $R^3$ | $Z^1$ |
|---|---|---|---|
| I-17 | 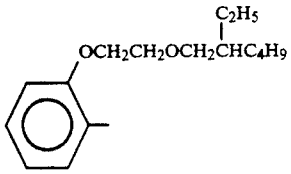 | 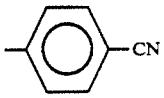 | 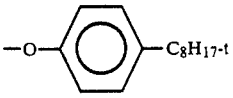 |
| I-18 | 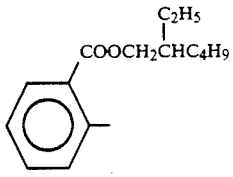 | 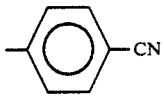 | 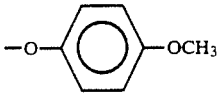 |
| I-19 | 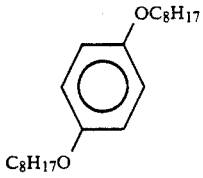 | 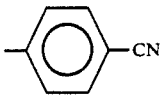 | $-SCH_2COOH$ |
| I-20 | 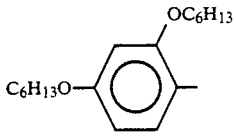 | 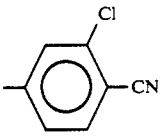 | $-SCH_2CH_2N(CH_3)_2$ |
A typical route for the synthesis of cyan dye forming couplers used in the present invention represented by formula (I) is shown schematically below.
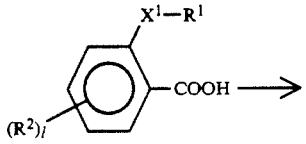
a
-continued
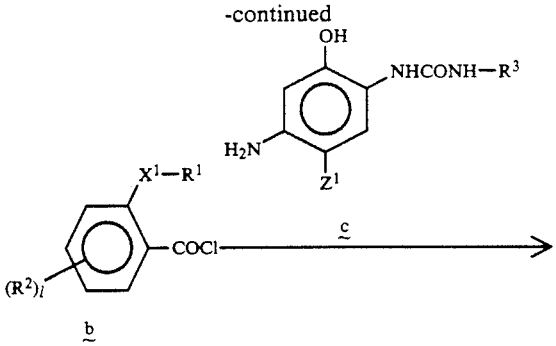
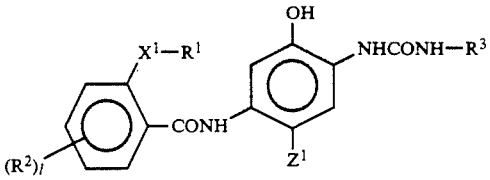
(I)

Compound can be derived easily using known methods from salicylic acids, thiosalicylic acids, phthalic acid anhydrides or anthranilic acids.

The production of b from a can be carried out by reacting with thionyl chloride, phosphorus oxychloride, phosphorus pentachloride, oxalyl chloride etc, in the absence of a solvent or in the presence of a solvent such as methylene chloride, chloroform, carbon tetrachloride, dichloroethane, toluene, N,N-dimethylformamide or N,N-dimethylacetamide, for example. The reaction temperature is generally from −20° C. to 150° C., and preferably from −10° C. to 80° C.

Compound can be prepared using methods of synthesis described, for example, in U.S. Pat. No. 4,333,999, JP-A-60-35731, JP-A-61-2757, JP-A-61-42658 and JP-A-63-208562.

The reaction of b and a can be carried out in the absence of a solvent or in the presence of a solvent such as acetonitrile, ethyl acetate, tetrahydrofuran, dioxane, N,N-dimethylformamide, N,N-dimethylacetamide, N,N'-dimethylimidazolin-2-one for example, generally at a temperature of from −20° C. to 150° C. and preferably of from −10° C. to 80° C. A weak base such as pyridine, imidazole, N,N-dimethylaniline, for example, can be used at this time. The cyan couplers represented by formula (I) can also be prepared by the direct dehydration/condensation of a and c, and in such a case N,N'-dicyclohexylcarbodiimide or carbonyldiimidazole, for example, can be used as a condensing agent.

SYNTHESIS EXAMPLE

Preparation of Coupler I-5

2-Hexyldodecanol (24.2 grams) and 7.9 grams of pyridine were dissolved in 100 ml of ethyl acetate and 14.8 grams of phthalic acid anhydride were added at room temperature (about 20°-30° C.) with stirring. After stirring the mixture for 3 hours at 50° C., the reaction mixture was transferred to a separation funnel, washed twice with dilute hydrochloric acid (1N) and concentrated.

The concentrate was dissolved in 50 ml of methylene chloride, 0.3 ml of N,N-dimethylformamide were added and 13 grams of oxalyl chloride were added dropwise over a period of about 30 minutes at room temperature with stirring. After stirring for about 1 hour, the mixture was concentrated and 2-dodecyloxycarbonylbenzoyl chloride was obtained in the form of an oil.

5-Amino-2-[3-cyanophenyl)ureido]phenol (24.2 grams) prepared using the synthesis method described in U.S. Pat. No. 4,333,999 was dissolved in 200 ml of dimethylacetamide and 2-dodecyloxycarbonylbenzoyl chloride was added dropwise over a period of about 30 minutes at room temperature with stirring. After the addition, the mixture was stirred for 2 hours and then the reaction mixture was transferred to a separation funnel. Ethyl acetate (500 ml) was added and the mixture was washed twice with dilute hydrochloric acid (1N) and then with a saturated aqueous sodium bicarbonate solution, after which it was dried over sodium sulfite. The ethyl acetate solution was concentrated to about half the original amount and the crystals which precipitated out were recovered by filtration. On drying, 36.9 grams of the target Coupler I-5 were obtained. The melting point of this compound was 185° C. to 189° C. and the structure was confirmed using $^1$H NMR spectroscopy, mass spectrometry and elemental analysis.

Cyan dye forming couplers represented by formula (C) are described in detail below.

In formula (C), $R_1$ represents $-CONR_4R_5$, $-SO_2NR_4R_5$, $-NHCOR_4$, $-NHCOOR_6$, $-NHSO_2R_6$, $-NHCONR_4R_5$ or $-NHSO_2NR_4R_5$, and $R_4$, $R_5$ and $R_6$ each independently represents an alkyl group which has a total number of carbon atoms (again referred to hereinafter as the C number) of from 1 to 30, an aryl group of C number from 6 to 30, or a heterocyclic group of C number from 2 to 30. $R_4$ and $R_5$ may also be hydrogen atoms.

$R_2$ represents a group (or an atom, hereinafter the same) which can be substituted on a naphthalene ring, and typical examples include halogen atoms (e.g., F, Cl, Br, I), hydroxyl groups, carboxyl groups, amino groups, sulfo groups cyano groups, alkyl groups, aryl groups, heterocyclic groups, carbonamido groups, sulfonamido groups, carbamoyl groups, sulfamoyl groups, ureido groups, acyl groups, acyloxy groups, alkoxy groups, aryloxy groups, alkylthio groups, arylthio groups, alkylsulfonyl groups, arylsulfonyl groups, sulfamoylamino groups, alkoxycarbonylamino groups, nitro groups and imido groups. Examples when l=2 include a dioxymethylene group and a trimethylene group. The C number of $(R_2)_l$ is from 0 to 30.

$R_3$ represents a substituent group, and it is preferably represented by the formula (C-1) indicated below.

$$R_7(Y_1)_m- \qquad \text{(C-1)}$$

In formula (C-1), $Y_1$ represents >NH, >CO or $>SO_2$, m represents an integer of value 0 or 1, and $R_7$ represents a hydrogen atom, an alkyl group of C number from 1 to 30, an aryl group of C number from 6 to 30, a heterocyclic group of C number from 2 to 30, $-COR_8$,

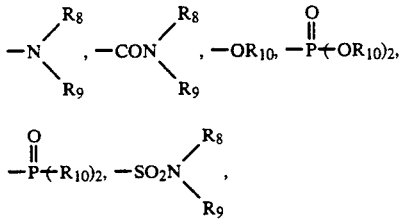

$CO_2R_{10}$,

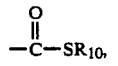

$-SO_2OR_{10}$ or $-SO_2R_{10}$. Here, $R_8$, $R_9$ and $R_{10}$ have the same significance as $R_4$, $R_5$ and $R_6$ respectively described above.

$R_4$ and $R_5$ in

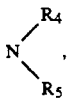

and $R_8$ and $R_9$ in

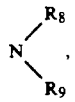

in $R_1$ or $R_7$, may combine and form a nitrogen containing heterocyclic ring (for example a pyrrolidine, piperidine or morpholine ring).

$X_1$ represents a hydrogen atom or a coupling-off group (known as a leaving group, including the atom which is eliminated, hereinafter the same), and typical of leaving groups include halogen atoms, $-OR_{11}$, $-SR_{11}$, $$-\underset{\underset{O}{\|}}{OCR_{11}},\ -NHCOR_{11},\ -\underset{\underset{O}{\|}}{NHCSR_{11}}-,$$

$$-\underset{\underset{O}{\|}}{OCOR_{11}},\ -\underset{\underset{O}{\|}}{OCNHR_{11}},$$

thiocyanato groups, and heterocyclic groups which have a C number of from 1 to 30 which are bonded to the coupling active position through a nitrogen atom (for example, succinimido, phthalimido, pyrazolyl, hydantoinyl, 2-benzotriazolyl). Here, $R_{11}$ has the same significance as $R_6$ described above.

Examples of substituent groups preferred in formula (C) are indicated below.

For $R_1$, $-CONR_4R_5$ or $-SO_2NR_4R_5$ is preferred, and specific examples include carbamoyl, N-n-butylcarbamoyl, N-n-dodecylcarbamoyl, N-(3-n-dodecyloxypropyl)carbamoyl, N-cyclohexylcarbamoyl, N-[3-(2,4-di-tert-pentylphenoxy)propyl]carbamoyl, N-hexadecylcarbamoyl, N-[4-(2,4-di-tert-pentylphenoxy)butyl]carbamoyl, N-(3-dodecyloxy-2-methylpropyl)carbamoyl, N-[3-(4-tert-octylphenoxy)propyl]carbamoyl, N-hexadecyl-N-methylcarbamoyl, N-(3-dodecyloxypropyl)-sulfamoyl and N-[4-(2,4-di-tert-pentylphenoxy)butyl]-sulfamoyl. $R_1$ is most preferably $-CONR_4R_5$.

For $R_2$ and l, l=0, i.e., where there is no substituent, is most preferred, followed by l=1. $R_2$ is preferably a halogen atom, an alkyl group (for example, methyl, iso-propyl, tert-butyl, cyclopentyl), a carbonamido group (for example, acetamido, pivalamido, trifluoroacetamido, benzamido), a sulfonamido group (for example, methanesulfonamido, toluenesulfonamido) or a cyano group.

With $R_3$, m is preferably 0 in formula (C-1), and more preferably $R_7$ is $-COR_8$ [for example, formyl, acetyl, trifluoroacetyl, 2-ethylhexanoyl, pivaloyl, benzoyl, pentafluorobenzoyl, 4-(2,4-di-tert-pentylphenoxy)butanoyl], $-COOR_{10}$ [for example, methoxycarbonyl, ethoxycarbonyl, iso-butoxycarbonyl, 2-ethylhexyloxycarbonyl, n-dodecyloxycarbonyl, 2-methoxyethoxycarbonyl] or $-SO_2R_{10}$ [for example, methylsulfonyl, n-butylsulfonyl, n-hexadecylsulfonyl, phenylsulfonyl, p-tolylsulfonyl, p-chlorophenylsulfonyl trifluoromethylsulfonyl], and $R_7$ is most preferably $-COOR_{10}$.

$X_1$ is preferably a hydrogen atom, a halogen atom, $-OR_{11}$ for example, alkoxy groups such as ethoxy, 2-hydroxyethoxy, 2-methoxyethoxy 2-(2-hydroxyethoxy)ethoxy, 2-methylsulfonylethoxy, ethoxycarbonylmethoxy, carboxymethoxy, 3-carboxypropoxy, N-(2-methoxyethyl)carbamoylmethoxy), 1-carboxytridecyloxy, 2-methanesulonamidoethoxy, 2-(carboxymethylthio)ethoxy, 2-(1-carboxytridecylthio)ethoxy and aryloxy groups such as 4-cyanophenoxy, 4-carboxyphenoxy, 4-methoxyphenoxy, 4-tert-octylphenoxy, 4-nitrophenoxy, 4-(3-carboxypropanamido)phenoxy, 4-acetamidophenoxy], or $-SR_{11}$ [for example, alkylthio groups such as carboxymethylthio, 2-carboxymethylthio, 2-methoxyethylthio, ethoxycarbonylmethylthio, 2,3-dihydroxypropylthio, 2-(N,N-dimethylamino)ethylthio and arylthio groups such as 4-carboxyphenylthio, 4-methoxyphenylthio, 4-(3-carboxypropanamido)phenylthio], and it is most preferably a hydrogen atom, a chlorine atom, an alkoxy group or an alkylthio group.

The couplers represented by formula (C) may form dimers or larger oligomers by bonding together via di- or higher valent groups as described for $R_1$, $R_2$, $R_3$ or $X_1$. In this case, the above-described substituent groups may be outside the indicated carbon number range.

In those cases where a coupler represented by the formula (C) forms an oligomer, it is typically a homopolymer or copolymer of an addition polymerizable ethylenic unsaturated compound which has a cyan dye forming coupler residue group (cyan color forming monomer), and it is preferably represented by formula (C-2)

$$-(G_i)_{gi}-(H_j)_{hj}- \qquad \text{(C-2)}$$

In formula (C-2), $G_i$ is a repeating unit derived from a color forming monomer, this being a group represented by formula (C-3), and $H_j$ is a group which forms a repeating unit derived from a non-color forming monomer, i is a positive integer and j is 0 or a positive integer, and gi and hi indicate the proportions by weight of $G_i$ and $H_j$ respectively. When i or j is two or more, $G_i$ or $H_i$ can include a number of different types of repeating units.

(C-3)

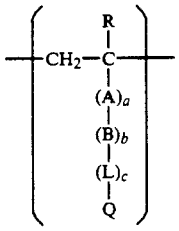

In formula (C-3), R represents a hydrogen atom, an alkyl group which has from 1 to 4 carbon atoms or a chlorine atom, A represents —CONH—, —COO— or a substituted or unsubstituted phenylene group, B represents a divalent group which has a carbon atom at both ends, such as a substituted or unsubstituted alkylene group, phenylene group, oxydialkylene group, and L represents —CONH—, —NHCONH—, —NHCOO—, —NHCO—, —OCONH—, —NH—, —COO—, —OCO—, —CO, —O—, $-SO_2-$, $NHSO_2$ or $-SO_2NH-$. Moreover, a, b and c represent integers of 0 or 1. Q represents a cyan coupler residue group in which one hydrogen atom has been removed from $R_1$, $R_2$, $R_3$ or $X_1$ of a compound represented by the formula (C).

The non-color forming ethylenic type monomer which does not couple with the oxidation product of a primary aromatic amine and- which provides the repeating unit $H_j$ may be, for example, acrylic acid, α-chloroacrylic acid, α-alkylacrylic acid (for example, methacrylic acid), amides and esters derived from these acrylic acids (for example, acrylamide, methacrylamide, n-butylacrylamide, tert-butylacrylamide, diacetoneacrylamide, methyl acrylate, ethyl acrylate, n-propyl acrylate, n-butyl acrylate, tert-butyl acrylate, isobutyl acrylate, 2-ethylhexyl acrylate, n-octyl acrylate, lauryl acrylate, methyl methacrylate, ethyl methacrylate, n-butyl methacrylate and β-hydroxyethyl methacrylate), vinyl esters (for example, vinyl acetate, vinyl propionate and vinyl laurate), acrylonitrile, methacrylonitrile, aromatic vinyl compounds (for example, styrene and derivatives thereof, such as vinyl toluene, divinylbenzene, vinyl acetophenone and sulfostyrene), itaconic acid, citraconic acid, crotonic acid, vinylidene chloride, vinyl alkyl ether (for example, vinyl ethyl ether), maleic acid esters, N-vinyl-2-pyrrolidone, N-vinylpyridine and 2- and 4-vinylpyridine.

Acrylic acid esters, methacrylic acid esters and maleic aid esters are especially preferred. Two or more types of non-color forming ethylenic monomers can be used in combination. For example, methyl acrylate and butyl acrylate, butyl acrylate and styrene, butyl methacrylate and methacrylic acid or methyl acrylate and diacetoneacrylamide can be used in combination.

The ethylenically unsaturated monomer for copolymerization with the vinyl based monomer corresponding to the aforementioned formula (C-3) can be selected in such a way that the form of the copolymer which is obtained, for example whether it has a solid, liquid or micelle form and the physical and/or chemical properties, for example solubility (solubility in water or organic solvents), compatibility with binding agents such as gelatin, for example, which are used in photographic colloid compositions, flexibility, heat stability, coupling activity with the oxidized form of developing agents and fastness to diffusion in photographic colloids, are all favorably affected as is well known in the polymer coupler field. These copolymers may be random copolymers or copolymers which have a specified sequence (for example, block copolymers, alternating copolymers).

The number average molecular weight of the cyan polymer couplers which can be used in the present invention is generally from a few thousand to a few million, and oligomeric polymer couplers of number average molecular weight less than 5000 can also be used.

The cyan polymer couplers used in the present invention may be lipophilic polymers which are soluble in organic solvents (for example, ethyl acetate, butyl acetate, ethanol, methylene chloride, cyclohexanone, dibutyl phthalate, tricresyl phosphate) or hydrophilic polymers which can be mixed with hydrophilic colloids such as aqueous gelatin solutions, or they may be polymers which have a structure and nature which form micelles in hydrophilic colloids.

The selection of lipophilic non-color forming ethylenic monomers (for example, acrylic acid esters, methacrylic acid esters, maleic acid esters, vinylbenzenes) for the main copolymer component is preferred for obtaining lipophilic polymer couplers which are soluble in organic solvents.

A lipophilic polymer coupler obtained by polymerizing a vinyl monomer which provides coupler units represented by the aforementioned formula (C-3) can be dissolved in an organic solvent and emulsified and dispersed in the form of a latex in an aqueous gelatin solution, or it can be prepared using a direct emulsion polymerization method.

The method for the emulsification and dispersion of lipophilic polymer couplers in aqueous gelatin solutions in the form of a latex disclosed in U.S. Pat. No. 3,451,820 can be used, and the methods disclosed in U.S. Pat. Nos. 4,080,211 and 3,370,952 can be used for emulsion polymerization.

Furthermore, the use of hydrophilic non-color forming ethylenic monomers such as N-(1,1-dimethyl-2-sulfonatoethyl)-acrylamide, 3-sulfonatopropyl acrylate, sodium styrenesulfonate, potassium styrenesulfinate, acrylamide, methacrylamide, acrylic acid, methacrylic acid, N-vinylpyrrolidone, and N-vinylpyridine for example as copolymer components is preferred for obtaining hydrophilic polymer couplers which are soluble in neutral or alkaline solution.

Hydrophilic polymer couplers can be added as aqueous solutions to a coating liquid, and they can also be dissolved in mixed solvents comprising water and an organic solvent which is miscible with water such as a lower alcohol, tetrahydrofuran, acetone, ethyl acetate, cyclohexanone, ethyl lactate, dimethylformamide or dimethylacetamide for addition. Moreover, they can be dissolved in aqueous alkali solutions or in alkaline water containing organic solvents for addition. Furthermore, a small amount of surfactant can be added, if desired.

Specific examples of the substituents in formula (C) and of cyan couplers represented by formula (C) are indicated below.

EXAMPLES OF $R_1$ $-CONH(CH_2)_3O-A$ $-CONH(CH_2)_4O-A$
$-CONH(CH_2)_3OC_{12}H_{25}\text{-}n$ $-CONH(CH_2)_3OC_{10}H_{21}\text{-}n$ $-CONH(CH_2)_3OCH_2\overset{C_2H_5}{\overset{|}{C}}HC_4H_9\text{-}n$ $-CONHC_{16}H_{33}\text{-}n$ $-CONHCH_2\overset{CH_3}{\overset{|}{C}}HCH_2C_{12}H_{25}\text{-}n$ $-CONH(CH_2CH_2O)_2C_{12}H_{25}\text{-}n$
$-CONHCH_2CH_2OC_{12}H_{25}\text{-}n$

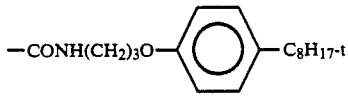

$-CONHCH_2\overset{C_6H_{13}}{\overset{|}{C}}HC_8H_{17}\text{-}n$

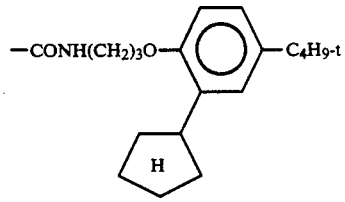

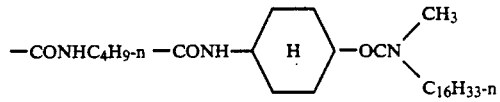

$-CONH(CH_2)_3OC_{14}H_{29}\text{-}n$ $-CONH(CH_2)_3OC_{11}H_{23}\text{-}n$
$-SO_2NH(CH_2)_3OC_{12}H_{25}\text{-}n$ -continued
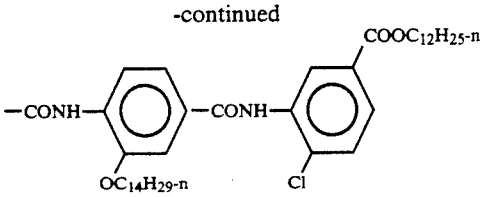
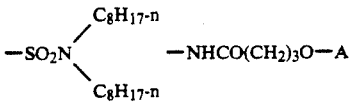
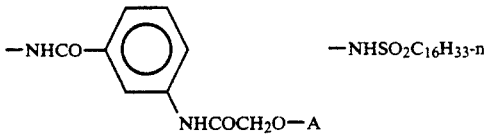
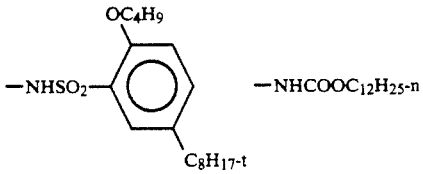
EXAMPLES OF $R_2$
$-F$ $-Cl$ $-CN$ $-CH_3$ $-CF_3$ $-C_4H_{9}\text{-}t$ $-C_8H_{17}\text{-}t$
$-NHCOCH_3$ $-NHSO_2CH_3$ $-NHCOOC_2H_5$
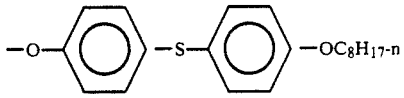
EXAMPLES OF $R_3NH-$
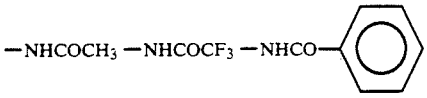
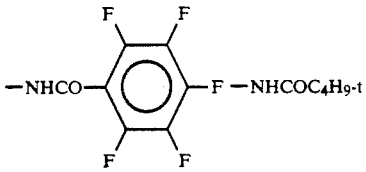
-continued
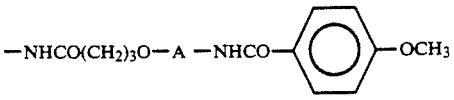
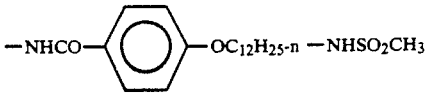
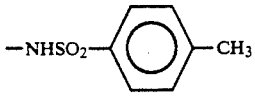
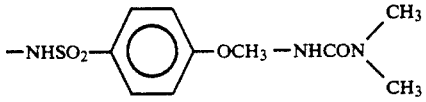
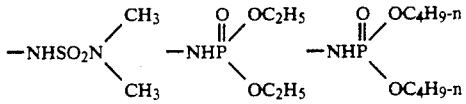
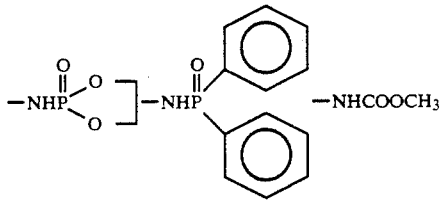
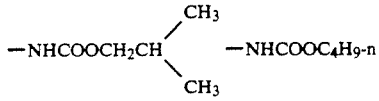
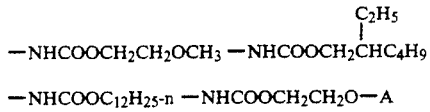
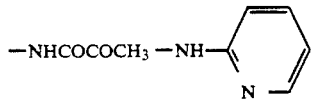
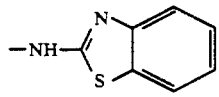
EXAMPLES OF $X_1$
$-OC_2H_5$ $-OCH_2CH_2OH$ $-OCH_2CH_2SO_2CH_3$
$-O(CH_2CH_2O)_2H$ $-OCH_2COOH$
$-O(CH_2)_3COOH$ $-OCH_2COOC_2H_5$
$-OCH_2CONHCH_2CH_2OCH_3$
$-OCH_2CH_2SCH_2COOH$ $-OCH_2CH_2S\overset{C_{12}H_{25}\text{-}n}{\overset{|}{C}}HCOOH$
$-OCH_2CH_2OCH_3$ $-OCH_2CH_2NHSO_2CH_3$ -continued
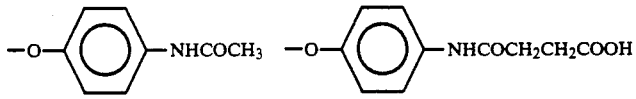
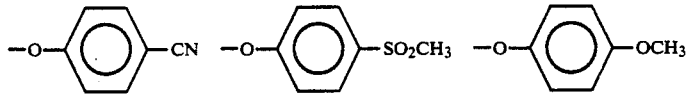
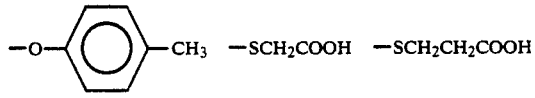
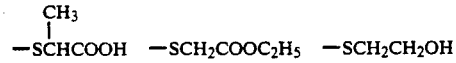
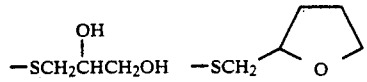
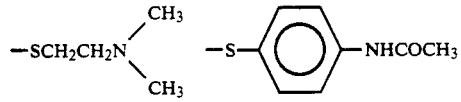
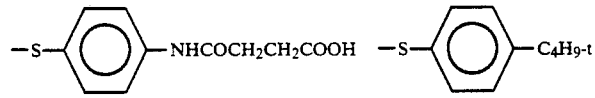
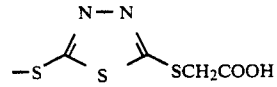
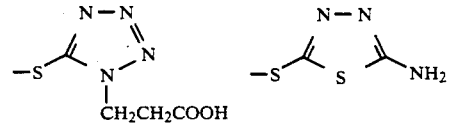
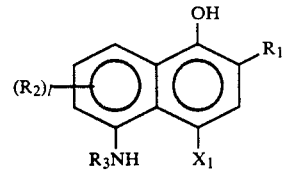
Couplers l = 0
| Coupler Number | $R_1$ | $R_3$ | $X_1$ |
|---|---|---|---|
| C-1 | —CONH(CH2)3O—A | CH3CO— | H |
| C-2 | —CONH(CH2)3O—A | CF3CO— | H |
| C-3 | —CONH(CH2)3O—A | CH3SO2— | H |
| C-4 | —CONH(CH2)3O—A | C2H5OCO— | H |
| C-5 | —CONH(CH2)4O—A | t-C4H9CO— | H |
| C-6 | —CONH(CH2)3O—C12H25-n | C2H5OCO— | H |
| C-7 | —CONH(CH2)3O—C12H25-n | i-C4H9OCO— | H |
| C-8 | —CONH(CH2)3OC10H21-n | i-C4H9OCO— | H |
| C-9 | —CONH(CH2)3OC10H21-n | n-C4H9CH(C2H5)CH2OCO— | H |
| C-10 | —CONH(CH2)3O—A | i-C4H9OCO— | H |

-continued

| | | | |
|---|---|---|---|
| C-11 | 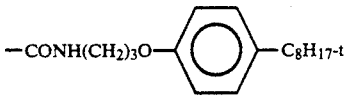 | i-$C_4H_9OCO$— | H |
| C-12 | $-CONHCH_2\overset{CH_3}{\overset{\vert}{C}}HCH_2OC_{12}H_{25}$-n | i-$C_4H_9OCO$— | H |
| C-13 | $-CONH(CH_2)_3OCH_2\overset{C_2H_5}{\overset{\vert}{C}}HC_4H_9$ | n-$C_8H_{17}OCO$— | H |
| C-14 | 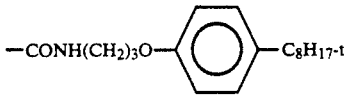 | n-$C_4H_9SO_2$— | H |
| C-15 | $-CONH(CH_2)_3OC_{12}H_{25}$-n | $(C_2H_5O)_2\overset{O}{\overset{\Vert}{P}}$— | H |
| C-16 | $-CONH(CH_2)_3O-A$ | 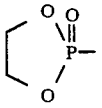 | H |
| C-17 | $-CONHCH_2CH_2OC_{12}H_{25}$-n | i-$C_4H_9OCO$— | H |
| C-18 | $-CON\begin{matrix}CH_3\\C_{16}H_{33}\text{-n}\end{matrix}$ | $C_2H_5OCO$— | H |
| C-19 | $-CONHCH_2CH_2OCOC_{11}H_{23}$-n | i-$C_4H_9OCO$— | H |
| C-20 | $-CONHC_{12}H_{25}$-n | n-$C_4H_9\overset{CH_3}{\overset{\vert}{C}}HCH_2OCO$— | H |
| C-21 | $-SO_2NH(CH_2)_3OC_{12}H_{25}$-n | i-$C_4H_9OCO$— | H |
| C-22 | $-SO_2N\begin{matrix}CH_3\\C_{18}H_{37}\text{-n}\end{matrix}$ | $C_2H_5OCO$— | H |
| C-23 | $-CONHCH_2\overset{C_6H_{13}\text{-n}}{\overset{\vert}{C}}HC_8H_{17}$-n | i-$C_4H_9OCO$— | H |
| C-24 | $-CONH(CH_3)_3OC_{12}H_{25}$-n | 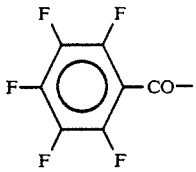 | H |
| C-25 | 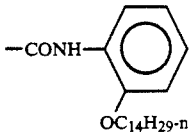 | $CH_3SO_2$— | H |
| C-26 | 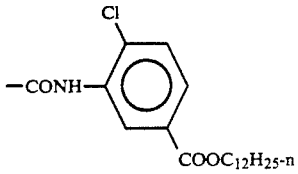 | 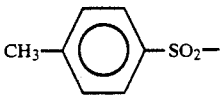 | H |
| C-27 | $-CONH(CH_2)_3OC_{12}H_{25}$-n | i-$C_4H_9OCO$— | Cl |

-continued

| | | | |
|---|---|---|---|
| C-28 | $-CONH(CH_2)_3OC_{12}H_{25}$-n | n-$C_4H_9OCO-$ | Cl |
| C-29 | $-CONH(CH_2)_3OC_{14}H_{29}$-n | t-$C_4H_9CO-$ | Cl |
| C-30 | $-CONH(CH_2)_3OC_{12}H_{25}$-n | i-$C_4H_9OCO-$ | $-OCH_2CH_2OH$ |
| C-32 | $-CONH(CH_2)_3OC_{12}H_{25}$-n | i-$C_4H_9OCO-$ | $-O(CH_2CH_2O)_2H$ |
| C-33 | $-CONH(CH_2)_3OC_{12}H_{25}$-n | i-$C_4H_9OCO-$ | $-OCH_2CH_2OCH_3$ |
| C-34 | $-CONH(CH_2)_3OC_{12}H_{25}$-n | i-$C_4H_9OCO-$ | $-OCH_2CH_2SCH_2COOH$ |
| C-35 | $-CONHC_4H_9$-n | i-$C_4H_9OCO-$ | $-OCH_2CH_2S(COOH)CHC_{12}H_{25}$-n |
| C-36 | $-CONHCH_2(CH_3)CHCH_2OC_{12}H_{25}$-n | i-$C_4H_9OCO-$ | $-O(CH_2)_3COOH$ |
| C-37 | $-CONH(CH_2)_4O-A$ | i-$C_4H_9OCO-$ | 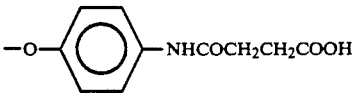 |
| C-38 | $-CONH(CH_2)_3O-A$ | i-$C_4H_9OCO-$ | 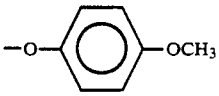 |
| C-39 | 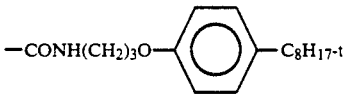 | i-$C_4H_9OCO-$ | $-SCH_2COOH$ |
| C-40 | $-CONH(CH_2)_3OC_{12}H_{25}$-n | i-$C_4H_9OCO-$ | $-SCH_2CH_2COOH$ |
| C-41 | $-CONH(CH_2)_3OC_{12}H_{25}$-n | i-$C_4H_9OCO-$ | $-SCH_2CH_2OH$ |
| C-42 | $-CONH(CH_2)_4O-A$ | $CH_3SO_2-$ | 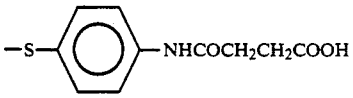 |
| C-43 | $-SO_2NH(CH_2)_3O-A$ | n-$C_4H_9SO_2-$ | $-OCH_2CH_2OH$ |
| C-44 | $-CONHCH_2(CH_3)CHCH_2OC_{12}H_{25}$-n | i-$C_4H_9OCO-$ | $-OCH_2CH_2OH$ |
| C-45 | $-CONH(CH_2CH_2O)C_{12}H_{25}$-n | $(C_2H_5O)_2P(=O)-$ | $-OCH_2CH_2OCH_3$ |
| C-46 | $-CONH(CH_2)_4O-A$ | t-$C_4H_9CO-$ | $-OCH_2COOC_2H_5$ |

Other Couplers of the Formula (C)

C-47

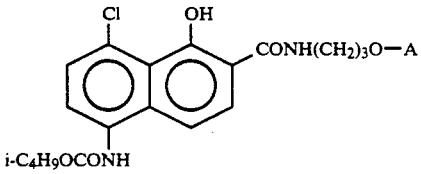

C-48

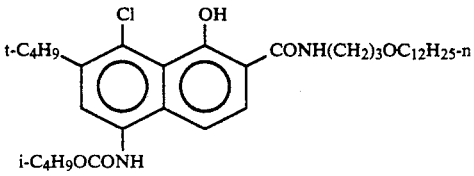

C-49

-continued

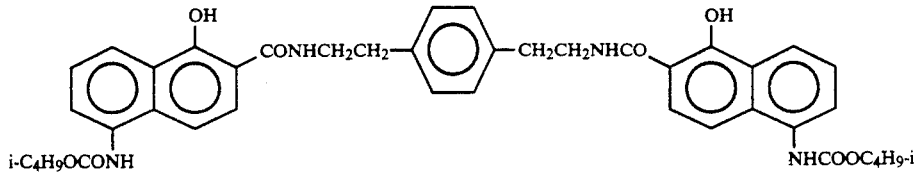

C-50

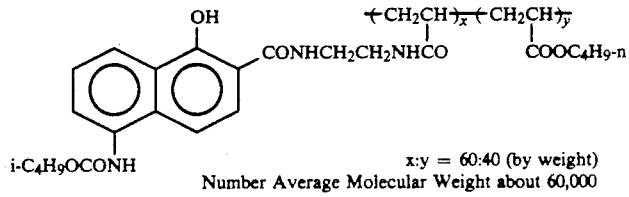

x:y = 60:40 (by weight)
Number Average Molecular Weight about 60,000

C-51

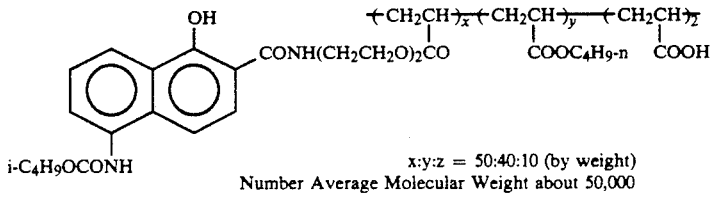

x:y:z = 50:40:10 (by weight)
Number Average Molecular Weight about 50,000

C-52

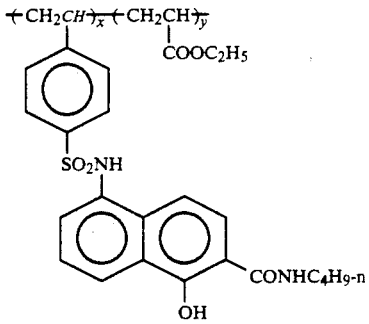

x:y = 70:30 (by weight)
Number Average Molecular Weight about 55,000

In the above, A represents

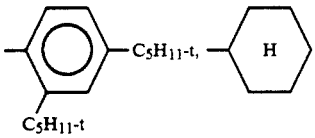

represents a cyclohexyl group,

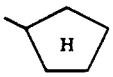

represents a cyclopentyl group and —$C_8H_{17}$—t represents

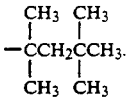

Specific examples of cyan couplers represented by formula (C) other than those described above and/or methods for the synthesis of these compounds are disclosed, for example, in U.S. Pat. No. 4,690,889, JP-A-60-237448, JP-A-61-153640, JP-A-61-145557, JP-A-63-208042, JP-A-64-31159 and West German Patent 3,823,049A.

The compounds represented by formulae (I) and (C) are preferably both added to the red sensitive silver halide emulsion layer, but they can be used in layers other than the red sensitive silver halide emulsion layer for color correction purposes. The compounds of formulae (I) and (C) may be co-emulsified and added to the same layer, or they may be added to different layers (for example to a low speed layer and a high speed layer).

The proportions in which the compounds represented by formulae (I) and (C) are added can vary, but the compound of formula (I) is preferably used in an amount of at least 50 mol %, and more preferably in an amount of at least 75 mol %, and most preferably in an amount of at least 90 mol % of the total moles of coupler of the formula (I) and coupler of the formula (C) present.

In the present invention, the above-described cyan couplers are generally used in an amount of from 0.002 to 2 mol, and preferably in an amount of from 0.01 to 0.3 mol, per mol of photosensitive silver halide. Furthermore, the coated amount the cyan couplers per square meter of the photosensitive material is from 0.01 to 5 mmol, and preferably is from 0.1 to 2 mmol.

The cyan couplers of the present invention can be introduced into the photosensitive material using the oil in water dispersion method. High boiling point organic solvents can be used in a ratio by weight with respect to the coupler of from 2.0 to zero. The ratio by weight of high boiling point organic solvent used is preferably from 1.0 to zero, and in comparison to other cyan couplers which have a similar structure the couplers of the present invention can be dispersed in a stable manner using a small amount of high boiling point organic solvent ranging from 1.0 to zero in terms of the ratio by weight. The fact that stable dispersions are obtained without using a high boiling point organic solvent is a distinguishing feature of the color photographic photosensitive materials of this present invention.

Coupler solvents described hereinafter can be used as coupler solvents in the present invention, if desired, but for cyan couplers the use, for example, of high boiling point organic solvents such as phthalic acid esters (for example, dibutyl phthalate, di-2-ethylhexyl phthalate, didodecyl phthalate, ethylphthalylethylglycolate), fatty acid esters (for example 2-ethylhexyl tetradecanoate, di-2-ethylhexyl adipate, di-2-ethylhexylsebacate, 2-ethylhexyl 9,10-epoxystearate), benzoic acid esters (for example 2-ethylhexyl benzoate, dodecylbenzoate, hexadecyl 4-hydroxybenzoate), phenols (for example, 2,4-di-tert-penthylphenol, 2,4-dinonylphenol, 2,4-didoecylphenol) and chlorinated paraffins (for example, paraffins with a 40 to 70 wt. % chlorine content) is preferred.

The cyan couplers of the present invention can be used in any photosensitive emulsion layer, nonphotosensitive emulsion layer or intermediate layer, but they are preferably added to and used in a photosensitive emulsion layer, and most desirably they are added to and used in the red sensitive silver halide emulsion layer.

The cyan couplers of the present invention may be used independently as cyan couplers or they can be used in combination with other cyan couplers, if desired. Preferred cyan couplers which can be used in combination with the cyan couplers of the present invention include 1-naphthol type cyan couplers, 5-amido-1-naphthol type cyan couplers (disclosed in U.S. Pat. No. 690,899 (sic) and JP-A-64-78252) and 2-ureidophenol type cyan couplers (disclosed in JP-A-64-2044). The amount of the other cyan couplers which can be used in combination with the cyan couplers of the present invention is preferably less than 50 wt. % based on the total amount of the cyan couplers.

The couplers of the present invention can be used, for example, in color papers, color reversal papers, color positive films, color negative films, color reversal films and color direct positive photosensitive materials. Their use in color negative films is especially preferred.

The silver halide emulsion of a photosensitive material as used in the present invention may have any halogen composition. For example, a silver iodobromide, silver bromide, silver chlorobromide or silver chloride emulsion may be used.

The halogen composition of the emulsion may be the same or different from grain to grain, but uniformity in the grains is facilitated when emulsions in which the halogen composition is uniform from grain to grain are used. Furthermore, the grains of the silver halide emulsion can comprise grains which have a so-called uniform type structure in which the composition is the same in all parts of the grains of the silver halide emulsion, grains which have a so-called layer type structure in which the silver halide composition is different in the interior core of the silver halide grains from that in the shell (which may be a single layer or a plurality of layers) which surrounds the core, or grains which have a part which has a different halogen composition in a non-layer-like form either within the grains or on the grain surface (in the case of the grain surface, the structure is such that the part which has a different composition is present on the edges, the corners or on the surfaces of the grain). These can be selected appropriately and used. The use of either of the latter two types of grains rather than grains which have a uniform structure enables high photographic speeds to be obtained, and these grains are also preferred from the standpoint of pressure resistance. Where the silver halide grains have a structure such as that described above, the boundary surface between the parts in which the halogen composition differs may be a distinct boundary, or mixed crystals may be formed with a composition difference and the boundary may be indistinct, or there may be a positive and continuous change in the structure.

The halogen composition differs depending on the type of photosensitive material being used. With print materials such as color papers, for example, silver chlorobromide emulsions are mainly used, while with camera materials such as color negative films, silver iodobromide emulsion are generally used.

Furthermore, the so-called high silver chloride emulsions which have a high silver chloride content are preferably used in photosensitive materials which are suitable for rapid processing. The silver chloride content of these high silver chloride emulsions is preferably at least 90 mol %, and most preferably at least 95 mol %.

Structures which have a layer-like or non-layer-like silver bromide localized phase either within the silver halide grains and/or at the grain surface as described earlier are preferred for such high silver chloride emulsions. The silver halide composition of the above described localized phase is preferably such that the silver bromide content is at least 10 mol %, and preferably in excess of 20 mol %. Hence, these localized layers can be present within the grains or on the edges or corners of the grain surfaces or on the surfaces of the grains, and in one preferred example, the localized phase is grown epitaxially on the corners of the grains.

The average grain size (the grain diameter in the case of grains which are spherical or approximately spherical, or, in the case of a cubic grain the edge length is taken for the grain size, the average being based on the projected area) is preferably not more than 2 μm but at least 0.1 μm, and most preferably not more than 1.5 μm but at least 0.15 μm. The grain size distribution may be narrow or wide, but the use of the so-called mono-disperse silver halide emulsions in which the value (coefficient of variation) obtained by dividing the standard deviation of the grain size distribution of the silver halide emulsion by the average grain size is within 20%, and preferably within 15%, is desirable in the present invention. Furthermore, two or more mono-disperse silver halide emulsions (preferably with a coefficient of variation as described above) which have different grain sizes can be employed in the same layer or lamination coated as separate layers for an emulsion layer unit which has essentially the same color sensitivity. Moreover, mixtures comprising laminations of or combinations of two or more types of poly-disperse silver halide emulsions or of mono-disperse and poly-disperse emulsions can also be used, if desired.

The crystalline form of the silver halide grains used in the present invention may be regular form, such as a cubic, octahedral, rhombo-dodecahedral or tetradecahedral form, or a combination of these regular forms. Alternatively, they may have an irregular crystalline form such as a spherical form, or they may have a form which is a composite of such forms. Furthermore, tabular grains may be used.

The silver halide photographic emulsions which can be used in the present invention can be prepared, for example, using the methods disclosed in *Research Disclosure* (RD) No. 17643 (December, 1978), pages 22 to 23, "I. Emulsion Preparation and Types", and ibid, No. 18716 (November 1979), page 648, in P. Glafkides, *Chimie et Physique Photographique*, published by Paul Montel, 1967, in G. F. Duffin, *Photographic Emulsion Chemistry*, published by Focal Press, 1966, and in V. L. Zelikmann et al., *Making and Coating Photographic Emulsions*, published by Focal Press, 1964.

The mono-dispersed emulsions disclosed, for example, in U.S. Pat. Nos. 3,574,628 and 3,655,394, and British Patent 1,413,748 are preferred.

Furthermore, tabular grains where the aspect ratio is at least about 5 can be used in the present invention. Tabular grains can be prepared easily using the methods described, for example, in Gutoff, *Photographic Science and Engineering*, Volume 14, pages 248 to 257 (1970), and in U.S. Pat. Nos. 4,434,226, 4,414,310, 4,433,048 and 4,439,520, and British Patent 2,112,157.

The crystal structure may be uniform, or the interior and exterior of the grains may have different halogen compositions, or the grains may have a layered structure and, moreover, silver halides which have different compositions may be joined with an epitaxial junction or they may be joined with compounds other than silver halides, such as silver thiocyanate or lead oxide, for example.

Mixtures of grains which have various crystalline forms may be used.

The silver halide emulsions which are used have generally been subjected to physical ripening, chemical ripening and spectral sensitization. Additives which are used for such purposes are disclosed in *Research Disclosure* Nos. 17643 and 18716, and these disclosures are summarized in the table below. Known photographically useful additives which can be used in this present invention are also disclosed in the two *Research Disclosure* references referred to above, and these disclosures are also indicated in the table below.

| | Type of Additive | RD 17643 | RD 18716 |
|---|---|---|---|
| 1. | Chemical Sensitizers | Page 23 | Page 648, right col. |
| 2. | Speed Increasing Agents | | As above |
| 3. | Spectral Sensitizers and Super-Sensitizers | Pages 23 to 24 | Pages 648 right col. to 649 right col. |
| 4. | Whiteners | Page 24 | |
| 5. | Anti-Foggants & Stabilizers | Pages 24 to 25 | Page 649, right col. |
| 6. | Light Absorbers, Filter Dyes and UV Absorbers | Pages 25 to 26 | Pages 649, right col. to 650, left col. |
| 7. | Anti-Staining Agents | Page 25, right col. | Page 650, left to right cols. |
| 8. | Dye Image Stabilizers | Page 25 | |
| 9. | Film Hardening Agents | Page 26 | Page 651, left col. |
| 10. | Binders | Page 26 | As above |
| 11. | Plasticizers, Lubricants | Page 27 | Page 650, right col. |
| 12. | Coating Aids, Surfactants | Pages 26 to 27 | Page 650, right col. |
| 13. | Anti-Static Agents | Page 27 | As above |

Furthermore, the addition of the compounds which can react with and fix formaldehyde disclosed in U.S. Pat. Nos. 4,411,987 and 4,435,503 to the photosensitive material is desirable for preventing a degradation of photographic performance due to contact with formaldehyde gas.

Various color couplers can be used in this present invention, and specific examples are disclosed in the patents cited in *Research Disclosure* (RD) No. 17643, sections VII-C to G, described above.

Those color couplers disclosed, for example, in U.S. Pat. Nos. 3,933,501, 4,022,620, 4,326,024, 4,401,752 and 4,248,961, JP-B-58-10739, British Patents 1,425,020 and 1,476,760, U.S. Pat. Nos. 3,973,968, 4,314,023 and 4,511,649, and European Patent 249473A are preferred as yellow couplers. (The term "JP-B" as used herein signifies an "examined Japanese patent publication".)

5-Pyrazolone based compounds and pyrazoloazole based compounds are preferred as magenta couplers, and those disclosed, for example, in U.S. Pat. Nos. 4,310,619 and 4,351,897, European Patent 73636, U.S. Pat. Nos. 3,061,432 and 3,725,064, *Research Disclosure* No. 24220 (June 1984), JP-A-60-33552, *Research Disclosure* No. 24230 (June 1984), JP-A-60-43659, JP-A-61-72238, JP-A-60-35730, JP-A-55-118034, JP-A-60-185951, U.S. Pat. Nos. 4,500,630, 4,540,654 and 4,556,630, and International Patent WO 88/04795 are especially preferred.

Phenol and naphthol based couplers are examples of cyan couplers which can be used in combination in the present invention with the cyan couplers of the formulae (I) and (C), and those phenol and naphthol couplers disclosed, for example, in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Laid Open 3,329,729, European Patents 121365A and 249453A, U.S. Pat. Nos. 3,446,622, 4,333,999, 4,775,616, 4,451,559, 4,427,767, 4,690,889, 4,254,212 and 4,296,199, and JP-A-61-42658 are preferred.

The colored couplers for correcting unwanted absorption of colored dyes disclosed, for example, in section VII-G of *Research Disclosure* No. 17643, U.S. Pat. No. 4,163,670, JP-B-57-39413, U.S. Pat. Nos. 4,004,929 and 4,138,258, and British Patent 1,146,368 are preferred. Furthermore, the use of couplers which correct for unwanted absorption of colored dyes using fluorescent dyes which are released on coupling as disclosed in U.S. Pat. Nos. 4,774,181, and couplers which have, as leaving groups, dye precursors which form dyes on reaction with the developing agent disclosed in U.S. Pat. No. 4,777,120 is also preferred.

The couplers disclosed in U.S. Pat. Nos. 4,366,237, British Patent 2,125,570, European Patent 96570 and West German Patent (Laid Open) 3,234,533 are preferred as couplers where the colored dyes have a suitable degree of diffusibility.

Typical examples of polymerized dye forming couplers are disclosed, for example, in U.S. Pat. Nos. 3,451,820, 4,080,211, 4,367,282, 4,409,320 and 4,576,910, and British Patent 2,102,173.

Couplers which release photographically useful residual groups on coupling are also preferred in the present invention. DIR couplers which release development inhibitors disclosed in the patents cited in section VII-F of *Research Disclosure* 17643, JP-A-57-51944, JP-A-57-154234, JP-A-60-184248, JP-A-63-37346, JP-A-63-37350, and U.S. Pat. No. 4,248,962 are preferred.

The couplers disclosed in British Patents 2,097,140 and 2,131,188, JP-A-59-157638 and JP-A-59-170840 are preferred as couplers which release nucleating agents or development accelerators in correspondence with the image formation during development.

Other couplers which can be used in photosensitive materials of the present invention include the competitive couplers disclosed, for example, in U.S. Pat. No. 4,130,427, the multi-equivalent couplers disclosed, for example, in U.S. Pat. Nos. 4,283,472, 4,338,393 and 4,310,618, the DIR redox compound releasing couplers, DIR coupler releasing couplers, DIR coupler releasing redox compounds or DIR redox releasing redox compounds disclosed, for example, in JP-A-60-185950 and JP-A-62-24252, the couplers which release dyes of which the color is restored after elimination disclosed in European Patents 173302A and 313308A, the bleach accelerator releasing couplers disclosed, for example, in *Research Disclosure* No. 11449 and ibid, No. 24241, and JP-A-61-201247, the ligand releasing couplers disclosed, for example, in U.S. Pat. No. 4,553,477, the leuco dye releasing couplers disclosed in JP-A-63-75747, and the couplers which release fluorescent dyes disclosed in U.S. Pat. No. 4,774,181.

The couplers which are used in the present invention can be introduced into the photosensitive material using various known dispersion methods.

Examples of high boiling point solvents which can be used in the oil in water dispersion method are disclosed, for example, in U.S. Pat. No. 2,322,027. Furthermore, specific examples of the process and effect of the latex loading method and a method of polymer dispersion, and of latexes for loading are disclosed in U.S. Pat. No. 4,199,363, and West German Patent Applications (OLS) 2,541,274 and 2,541,230, and methods of dispersion using organic solvent soluble polymers are disclosed in PCT International Patent W088/00723.

Examples of high boiling point organic solvents which can be used in the above-described oil in water dispersion method include alkyl esters of phthalic acid (for example, dibutyl phthalate, dioctyl phthalate), phosphate esters (for example, diphenyl phosphate, triphenyl phosphate, tricresyl phosphate, dioctylbutyl phosphate), citric acid esters (for example, tributyl acetylcitrate), benzoic acid esters (for example, 2-ethylhexyl benzoate, 2-ethylhexyl 2,4-dichlorobenzoate), alkylamides (for example, diethyllaurylamide), fatty acid esters (for example, dibutoxyethyl succinate, di-2-ethylhexyl succinate, 2-hexyldecyl tetradecanoic acid, tributyl citrate, diethyl azelate) and chlorinated paraffins (paraffins which have a chlorine content of from 10% to 80%), and organic solvents of a boiling point of 30° C. to 150° C., for example, lower alkyl acetates such as ethyl acetate and butyl acetate, ethyl propionate, sec-butyl alcohol, methyl isobutyl ketone, $\beta$-ethoxyethyl acetate, methylcellosolve acetate can be used in combination.

The standard amount of color coupler which is used is within the range of 0.001 to 1 mol per mol of photosensitive silver halide, and the yellow coupler is preferably used in an amount of from 0.01 to 0.5 mol per mol of photosensitive silver halide, the magenta coupler is preferably used in an amount of from 0.003 to 0.3 mol per mol of photosensitive silver halide and the cyan coupler is preferably used in an amount of from 0.002 to 0.3 mol per mol of photosensitive silver halide.

The addition of various fungicides and biocides such as the 1,2-benzisothiazolin-3-one, n-butyl p-hydroxybenzoate, phenol, 4-chloro-3,5-dimethylphenol, 2-phenoxyethanol and 2-(4-thiazolyl)benzimidazole disclosed in JP-A-63-257747, JP-A-62-272248 and JP-A-1-80941 to a color photosensitive material of the present invention is preferred.

The photographic photosensitive materials for the present invention are coated onto the flexible supports such as synthetic resin films (cellulose nitrate, cellulose acetate, poly(ethylene terephthalate) or rigid supports such as glass, for example, generally used for support purposes. Suitable supports and methods of coating are described in detail in *Research Disclosure*, volume 176, item 17643, sections XV (page 27) and XVII (page 28) (December 1978).

Photosensitive materials prepared using the present invention may contain, for example, hydroquinone derivatives, aminophenol derivatives, gallic acid derivatives and ascorbic acid derivatives as anti-color fogging agents.

Various anti-color fading agents can also be used in the photosensitive materials of the present invention. More specifically, hydroquinones, 6-hydroxychromans, 5-hydroxycoumarans, spirochromans, p-alkoxyphenols, hindered phenols, gallic acid derivatives, methylenedioxybenzenes, aminophenols, hindered amines, and ether and ester derivatives in which the phenolic hydroxyl groups of these compounds have been silylated or alkylated are typical organic anti-color mixing agents which can be used for cyan, magenta and/or yellow images. Furthermore, metal complexes exemplified by (bis-salicylaldoximato) nickel and (bis-N,N-dialkyldithiocarbamato) nickel complexes, for example, can also be used for this purpose.

Specific examples of organic anti-color fading agents are disclosed in the patent specifications indicated below.

More specifically, hydroquinones are disclosed, for example, in U.S. Pat. Nos. 2,360,290, 2,418,613, 2,700,453, 2,701,197, 2,728,659, 2,732,300, 2,735,765, 3,982,944 and 4,430,425, British Patent 1,363,921 and U.S. Pat. Nos. 2,710,801 and 2,816,028, 6-hydroxychromans, 5-hydroxycoumarans and spirochromans are disclosed, for example, in U.S. Pat. Nos. 3,432,300, 3,573,050, 3,574,627, 3,698,909 and 3,764,337, and JP-A-52-152225, spiroindanes are disclosed 4,360,589, p-alkoxyphenols are disclosed, for example, in U.S. Pat. No. 2,735,765, British Patent 2,066,975, JP-A-59-10539 and JP-B-57-19765, hindered phenols are disclosed, for example, in U.S. Pat. No. 3,700,455, JP-A-52-72224, U.S. Pat. No. 4,228,235 and JP-B-52-6623, gallic acid derivatives, methylenedioxybenzenes and aminophenols are disclosed, for example, in U.S. Pat. Nos. 3,457,079 and 4,332,886, and JP-B-56-21144 respectively, hindered amines are disclosed, for example, in U.S. Pat. Nos. 3,336,135 and 4,268,593, British Patents 1,326,889, 1,354,313 and 1,410,846, JP-B-51-1420, JP-A-58-114036, JP-A-59-53846 and JP-A-59-78433, and metal complexes are disclosed, for example, U.S. Pat. Nos. 4,050,938 and 4,241,155, and British Patent 2,027,731(A). These compounds can be added to the photosensitive layer after co-emulsification with the corresponding color coupler, generally in an amount of from 5 to 100 wt. % with respect to the coupler. The inclusion of ultraviolet absorbers in the cyan color forming layer and in the layers on both sides adjacent thereto is effective for preventing deterioration of the cyan dye image due to heat and, more especially, due to light.

For example, benzotriazole compounds substituted with aryl groups (for example, those disclosed in U.S. Pat. No. 3,533,794), 4-thiazolidone compounds (for example, those disclosed in U.S. Pat. Nos. 3,314,794 and 3,352,681), benzophenone compounds (for example, those disclosed in JP-A-46-2784), cinnamic acid ester compounds (for example, those disclosed in U.S. Pat. Nos. 3,705,805 and 3,707,395), butadiene compounds (for example, those disclosed in U.S. Pat. No. 4,045,229), or benzoxidol compounds (for example, those disclosed in U.S. Pat. No. 3,700,455) can be used as ultraviolet absorbers. Ultraviolet absorbing polymers, for example, can also be used for this purpose. These ultraviolet absorbers may be mordanted in a specified layer, if desired.

Of these compounds, the above-described benzotriazole compounds substituted with aryl groups are preferred.

Gelatin is used as a binding agent or protective colloid in the emulsion layers of the photosensitive material of the present invention, but other hydrophilic colloids, either alone or in combination with gelatin, can be used for this purpose.

The gelatin used in this invention may be lime treated gelatin, or it may be a gelatin which has been treated using acids. Details of the preparation of gelatins are disclosed in Arthur Weise, *The Macromolecular Chemistry of Gelatin* (published by Academic Press, 1964).

The color developers used in the development processing of the photosensitive materials of the present invention are preferably aqueous alkaline solutions which contain a primary aromatic amine based color developing agent as the principal developing component. Aminophenol based compounds are also useful as color developing agents, but the use of p-phenylenediamine based compounds is preferred. Typical examples of these compounds include 3-methyl-4-amino-N,N-diethylaniline, 3-methyl-4-amino-N-ethyl-N-8-hydroxyethylaniline, 3-methyl-4-amino-N-ethyl-N-8-methanesulfonamidoethylaniline, 3-methyl-4-amino-N-ethylN-8-methoxyethylaniline, and the sulfate, hydrochloride and p-toluenesulfonate salts of these compounds. Two or more of these compounds can be used in combination, if desired.

The color developer generally contains pH buffers such as alkali metal carbonates, borates or phosphates, and development inhibitors or anti-foggants such as bromide, iodide, benzimidazoles, benzothiazoles or mercapto compounds. It may also contain, as required, various preservatives such as hydroxylamine, diethylhydroxylamine, sulfite, hydrazines, phenylsemicarbazides, triethanolamine, catecholsulfonic acids and triethylenediamine(1,4-diazabicyclo[2,2,2]octane) compounds, organic solvents such as ethylene glycol and diethylene glycol, development accelerators such as benzyl alcohol, polyethylene glycol, quaternary ammonium salts and amines, dye forming couplers, competitive couplers, fogging agents such as sodium borohydride, auxiliary developing agents such as 1-phenyl-3-pyrazolidone, thickeners, and various chelating agents exemplified by aminopolycarboxylic acids, aminopolyphosphonic acids, alkylphosphonic acids and phosphonocarboxylic acids. Typical examples of these compounds include ethylenediamine tetraacetic acid, nitrilotriacetic acid, diethylenetriamine pentaacetic acid, cyclohexanediamine tetraacetic acid, hydroxyethyliminodiacetic acid, 1-hydroxyethylidene-1,1-diphosphonic acid, nitrilo-N,N,N-trimethylenephosphonic acid, ethylenediamine-N,N-N',N'-tetramethylenephosphonic acid, ethylenediamine-di(o-hydroxyphenylacetic acid) and salts of these acids.

Color development is carried out after a normal black and white development in cases where reversal processing is carried out. Known black and white developing agents, for example, dihydroxybenzenes such as hydroquinone, 3-pyrazolidones such as 1-phenyl-3-pyrazolidone or aminophenols such as N-methyl-p-aminophenol can be used individually, or in combination, in the black and white developer.

The pH of these color developers and black and white developers is generally within the range of 9 to 12. The replenishment rate of these developers depends on the color photographic material which is being processed, but it is generally 3 liters or less per square meter of the color photographic material, and it can be below 500 ml per square meter of the photographic material by reducing the bromide ion concentration in the replenisher. Prevention of evaporation and aerial oxidation of the liquid by reducing the area of contact with air in the processing tank is desirable in those cases where the replenishment rate is reduced. Furthermore, the replenishment rate can be further reduced by adopting means of suppressing the accumulation of bromide ion in the development bath.

The photographic material is generally subjected to a bleaching process after color development. The bleaching process may be carried out at the same time as the fixing process (in a bleach-fix process) or it may be carried out as a separate process. Moreover, a bleach-fix process can be carried out after a bleaching process in order to speed up the processing. Moreover, a bleach-fixing process can be carried out in two connected bleach-fix baths, a fixing process can be carried out before a bleach-fixing process or a bleaching process can be carried out after a bleach-fix process depending on the intended purposes.

Compounds of multi-valent metals, such as iron(III), cobalt(III), chromium(VI) and copper(II), peracids, quinones and nitro compounds, for example, can be used as bleaching agents. Typical bleaching agents include ferricyanides; dichromates; organic complex salts of iron(III) or cobalt(III), for example, complex salts with aminopolycarboxylic acids such as ethylenediamine tetraacetic acid, diethylenetriamine pentaacetic acid, cyclohexanediamine tetraacetic acid, methylimino diacetic acid, 1,3-diaminopropane tetraacetic acid and glycol ether diamine tetraacetic acid, or citric acid, tartaric acid or malic acid; persulfates; bromates; permanganates; and nitrobenzenes. Of these materials, polyaminocarboxylic acid iron(III) complex salts, principally ethylenediamine tetraacetic acid iron(III) complex salts, and persulfates, are preferred from the standpoints of both rapid processing and prevention of environmental pollution. Moreover, aminopolycarboxylic acid iron(III) complex salts are especially useful in both bleach baths and bleach-fix baths. The pH of the bleach baths and bleach-fix baths in which these aminopolycarboxylic acid iron(III) salts are used is normally from 5.5 to 8, but lower pH's can be used in order to speed up processing, if desired.

Bleaching accelerators can be used, as required, in the bleach baths, bleach-fix baths or bleach or bleach-fix pre-baths. Specific examples of useful bleach accelerators include compounds which have a mercapto group or a disulfide bond disclosed, for example, in U.S. Pat. No. 3,893,858, West German Patent 1,290,812, JP-A-53-95630 and *Research Disclosure* No. 17129 (June 1978); the thiazolidine derivatives disclosed in JP-A-50-140129; the thiourea derivatives disclosed in U.S. Pat. No. 3,706,561, the iodides disclosed in JP-A-58-16235; the polyoxyethylene compounds disclosed in West German Patent 2,748,430; the polyamine compounds disclosed in JP-B-45-8836; and bromide ion. Of these compounds, those which have a mercapto group or a disulfide group are preferred in view of their large accelerating effect, and the compounds disclosed in U.S. Pat. No. 3,893,858, West German Patent 1,290,812 and JP-A-53-95630 are especially preferred. Moreover, the compounds disclosed in U.S. Pat. No. 4,552,834 are also preferred. These bleach accelerators may also be added to a light sensitive material, if desired. These bleach accelerators are especially effective when bleach-fixing color photosensitive materials for camera use.

Thiosulfate, thiocyanate, thioether based compounds, thioureas and large amounts of iodide can be used, for example, as fixing agents, but thiosulfate is normally used, and ammonium thiosulfate in particular can be used in the widest range of applications. Sulfites, bisulfites or carbonyl bisulfite addition compounds are preferred as preservatives for bleach-fix baths.

The silver halide color photographic materials of the present invention are usually subjected to a water washing process and/or stabilization process after the de-silvering process. The amount of wash water used in the washing process can be fixed within a wide range, depending on the application and the nature (for example the materials such as couplers which have been used) of the photosensitive materials, the wash water temperature, the number of water washing tanks (the number of water washing stages) and the replenishment system, i.e. whether a counter flow or a sequential flow system is used, and other conditions. The relationship between the amount of water used and the number of washing tanks in a multi-stage counter-flow system can be obtained using the method described on pages 248 to 253 of the *Journal of the Society of Motion Picture and Television Engineers,* Volume 64 (May 1955).

The amount of wash water can be greatly reduced by using the multi-stage counter-flow system described above, but bacteria proliferate due to the increased residence time of the water in the tanks. Thus, problems arise with suspended matter which is produced and which attaches to the photosensitive material. The method in which the calcium ion and magnesium ion concentrations are reduced, as disclosed in JP-A-62-88838, is very effective as a means of overcoming this problem when processing color photosensitive materials of the present invention. Furthermore, the isothiazolone compounds and thiabendazoles disclosed in JP-A-57-8542, the chlorine based disinfectants such as chlorinated sodium isocyanurate, and benzotriazole, for example, and the disinfectants disclosed in Horiguchi, *The Chemistry of Biocides and Fungicides,* published by Sankyo Shuppan, 1986, *in Killing Micro-organisms, Biocidal and Fungicidal Techniques,* published by the Industrial Technology Association, 1982, and in *A Dictionary of Biocides and Fungicides,* edited by the Japanese Biocide and Fungicide Society publication (1986) can also be used in this connection.

The pH of the water wash water when processing photosensitive materials of the present invention is from 4 to 9, and preferably from 5 to 8. The washing water temperature and the washing time can be varied depending on the nature and application of the photosensitive materials but, in general, washing conditions of from 20 seconds to 10 minutes at a temperature of from 15° C. to 45° C., and preferably of from 30 seconds to 5 minutes at a temperature of from 25° C. to 40° C., are used. Moreover, the photosensitive materials of this invention can be processed directly in a stabilizing bath instead of being subjected to a water wash as described above. Known methods disclosed in JP-A-57-8543, JP-A-58-14834 and JP-A-60-220345 can be used in such a stabilizing process.

Furthermore, in some cases a stabilization process is carried out following the above-described water washing process, and stabilizing baths which contain formaldehyde and a surfactant which are used as final baths for camera color photosensitive materials are an example of such a process. Various chelating agents and fungicides can also be added to these stabilizing baths, if desired.

The overflow which accompanies replenishment of the above mentioned water washing or stabilizing baths can be reused in other processes, such as the desilvering process, for example.

Color developing agents can be incorporated into the silver halide color photosensitive material of the present invention to simplify and speed up processing. The incorporation of various color developing agent precursors is preferred. For example, the indoaniline based compounds disclosed in U.S. Pat. No. 3,342,597, the Shiff's base type compounds disclosed in U.S. Pat. No. 3,342,599 and *Research Disclosure* No. 14850 and ibid, No. 15159, the aldol compounds disclosed in *Research Disclosure* No. 13924, the metal complex salts disclosed in U.S. Pat. No. 3,719,492 and the urethane based compounds disclosed in JP-A-53-135628 can be used for this purpose.

Various 1-phenyl-3-pyrazolidones can also be incorporated, as desired, into the silver halide color photosensitive materials of the present invention to accelerate color development. Typical compounds of this type have been disclosed, for example, in JP-A-56-64339, JP-A-57-144547 and JP-A-58-115438.

The processing baths used in this invention are conducted at a temperature of from 10° C. to 50° C. A standard temperature is generally from 33° C. to 38° C., but accelerated processing and shorter processing times can be achieved at higher temperatures while, on the other hand, improved picture quality and better processing bath stability can be achieved at lower temperatures. Furthermore, processes using hydrogen peroxide intensification or cobalt intensification as disclosed in West German Patent 2,226,770 or U.S. Pat. No. 3,674,499 can be used in order to economize on silver in the photosensitive material.

The present invention is described in greater detail below by means of illustrative examples, but the present invention is not to be construed as being limited by these examples. Unless otherwise indicated herein, all parts, percents, ratios and the like are by weight.

EXAMPLE 1

Photosensitive materials (Samples 101 to 116) which form a single color comprising two layers, namely an emulsion layer and a protective layer, on an undercoated cellulose triacetate support were prepared using the compositions indicated below. The numerical values are indicated in units of g/m$^2$ except in the case of the couplers (for silver halides, the value is shown as silver).

| | |
|---|---|
| Emulsion Layer | |
| Silver Iodobromide Emulsion as silver (2 mol % AgI, average grain size 0.3 μm) | 0.8 |
| Gelatin | 1.2 |
| Coupler X (see Table 1) | Total number of mol per square meter |
| Coupler Y (see Table 1) | 0.001 |
| Dibutyl Phthalate | 0.3 |
| Protective Layer | |
| Gelatin | 0.9 |
| Poly(methyl methacrylate) Particles (diameter 1.5 μm) | 0.4 |
| 1-Oxy-3,5-dichloro-s-triazine sodium salt | 0.04 |

The samples prepared in this way (Samples 101 to were cut into strips of a length of 120 mm and, a width of 35 mm and, after exposure to white light at an exposure intensity of 40 CMS using a continuous density wedge, the samples were developed and processed in the manner shown below.

| Color Development Processing | |
|---|---|
| Color Development | 3 minutes 15 seconds |
| Bleach | 6 minutes 30 seconds |
| Fix | 4 minutes 20 seconds |
| Water Wash | 5 minutes |
| Stabilization | 1 minute |

The composition of the processing baths used for each process is indicated below.

| | |
|---|---|
| Color Development Bath | |
| Diethylenetriamine Pentaacetic Acid | 1.0 gram |
| 1-Hydroxyethylidene-1,1-diphosphonic Acid | 2.0 grams |
| Sodium Sulfite | 4.0 grams |
| Potassium Carbonate | 30.0 grams |
| Potassium Bromide | 1.4 grams |
| Potassium Iodide | 1.3 mg |
| Hydroxylamine Sulfate | 2.4 grams |
| 4-(N-Ethyl-N-β-hydroxyethylamino)-2-methylaniline Sulfate | 4.5 grams |
| Water to make up to | 1.0 liter |
| pH | 10.0 |
| Bleach Bath | |
| 1,3-Diaminopropane Tetraacetic Acid, Ferric Ammonium Salt | 105.0 grams |
| Ammonia (28% aq. soln.) | 3.0 ml |
| Ammonium Bromide | 150.0 grams |
| Ammonium Nitrate | 10.0 grams |
| Water to make up to | 1.0 liter |
| pH | 4.2 |
| Fixer Bath | |
| Ethylenediamine Tetraacetic Acid, Di-sodium Salt | 1.0 gram |
| Sodium Sulfite | 4.0 grams |
| Ammonium Thiosulfate (70% wt/vol aq. soln.) | 175.0 ml |
| Sodium Bisulfite | 4.6 grams |
| Water to make up to | 1.0 liter |
| pH | 6.6 |
| Stabilizing Bath | |
| Formaldehyde (40% aq. soln.) | 2.0 ml |
| Polyoxyethylene p-Monononylphenyl Ether (average degree of polymerization about 10) | 0.3 gram |
| Water to make up to | 1.0 liter |

The gamma value (the gradient from density 1.0 to density 2.0) and $D_{max}$ (the maximum color density) of the cyan colored samples (Samples 101 to 116) Obtained in the color development process were measured. Furthermore, the peak absorption wavelength was measured at color densities of 0.5 and 2.0 and $\Delta\lambda_{max}$ was obtained using the following equation:

$\Delta\lambda_{max}$ = Peak Absorption Wavelength at Color Density 2.0 − Peak Absorption Wavelength at Color Density 0.5

The gamma values, $D_{max}$ values and $\Delta\lambda_{max}$ values obtained in this way are shown in Table 1 below. The gamma values and $D_{max}$ values are shown as relative values taking the values for Sample 101 to be 1.

Comparative Couplers
(disclosed in JP-A-59-46644)

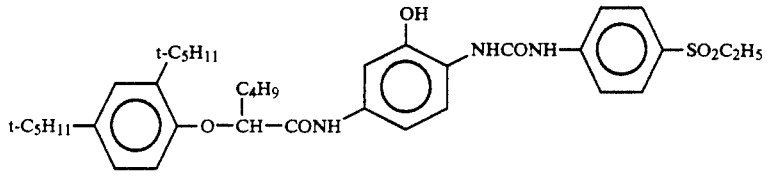

-continued (A-2)

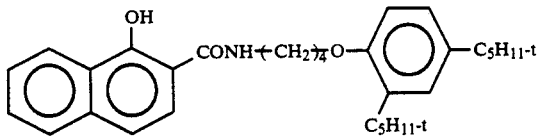

Comparative Couplers
(disclosed in JP-A-62-75444)

(B-1)

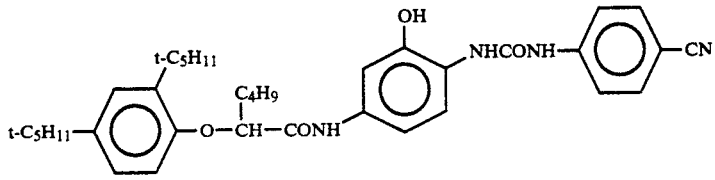

(B-2)

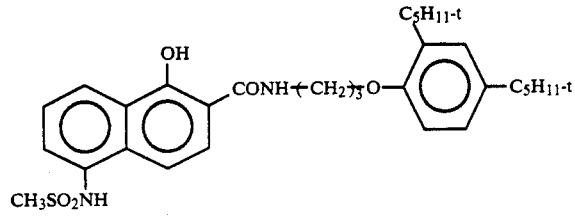

TABLE 1

| Sample No. | Coupler X | Coupler Y | Mol Fraction of Coupler X (%) | Gamma Value | $D_{max}$ | $\Delta\lambda_{max}$ (nm) |
|---|---|---|---|---|---|---|
| 101 (Comparative Example) | A-1 | A-2 | 75 | 1.00 | 1.00 | 7 |
| 102 (Comparative Example) | B-1 | B-2 | 50 | 0.95 | 0.97 | 8 |
| 103 (This Invention) | I-1 | C-1 | 50 | 1.22 | .123 | 7 |
| 104 (This Invention) | I-1 | C-1 | 75 | 1.31 | 1.29 | 5 |
| 105 (This Invention) | I-1 | C-1 | 90 | 1.39 | 1.40 | 6 |
| 106 (This Invention) | I-1 | C-10 | 90 | 1.42 | 1.43 | 6 |
| 107 (This Invention) | I-5 | C-7 | 90 | 1.38 | 1.37 | 6 |
| 108 (This Invention) | I-5 | C-14 | 90 | 1.49 | 1.41 | 7 |
| 109 (This Invention) | I-8 | C-7 | 90 | 1.35 | 1.42 | 7 |
| 110 (This Invention) | I-10 | C-24 | 90 | 1.45 | 1.40 | 4 |
| 111 (This Invention) | I-12 | C-1 | 90 | 1.51 | 1.44 | 6 |
| 112 (This Invention) | I-13 | C-7 | 90 | 1.32 | 1.35 | 4 |
| 113 (This Invention) | I-14 | C-25 | 90 | 1.27 | 1.29 | 7 |
| 114 (This Invention) | I-19 | C-1 | 90 | 1.35 | 1.36 | 5 |

TABLE 1-continued

| Sample No. | Coupler X | Coupler Y | Mol Fraction of Coupler X (%) | Gamma Value | $D_{max}$ | $\Delta\lambda_{max}$ (nm) |
|---|---|---|---|---|---|---|
| 115 (This Invention) | I-20 | C-7 | 90 | 1.41 | 1.41 | 5 |
| 116 (Comparative Example) | I-1 | A-2 | 50 | 1.05 | 1.04 | 8 |

It is clear from the results in Table 1 above that when a photosensitive material of the present invention is used, the coupling reactivity is higher than with the comparative coupler examples, and images which have a high maximum color density are obtained. Furthermore, the difference in the hue between areas of high and low density is satisfactorily small and this is desirable.

EXAMPLE 2

Multi-layer silver halide photosensitive materials (Samples 201 to 215) were prepared by a coating a photosensitive layer of the composition indicated below on an under-coated cellulose triacetate support.

Photosensitive Layer Composition

The numerical values corresponding to each component indicate the coated weight expressed as g/m$^2$, and, in the case of the silver halides, the coated weight is indicated as silver. In the case of the sensitizing dyes, the amount coated is indicated as mol of sensitizing dye per mol of silver halide in the same layer.

| | |
|---|---|
| First Layer (Anti-halation Layer) | |
| Black Colloidal Silver as silver | 0.18 |
| Gelatin | 2.0 |
| Second Layer (Intermediate Layer) | |
| 2,5-Di-tert-pentadecylhydroquinone | 0.18 |

-continued

| | |
|---|---|
| EX-1 | 0.07 |
| EX-3 | 0.02 |
| EX-12 | 0.002 |
| U-1 | 0.06 |
| U-2 | 0.08 |
| U-3 | 0.10 |
| HBS-1 | 0.10 |
| HBS-2 | 0.02 |
| Gelatin | 0.88 |
| Third Layer (First Red Sensitive Emulsion Layer) | |
| Emulsion A as silver | 0.25 |
| Emulsion B as silver | 0.25 |
| Sensitizing Dye I | $6.9 \times 10^{-5}$ |
| Sensitizing Dye II | $1.8 \times 10^{-5}$ |
| Sensitizing Dye III | $3.1 \times 10^{-4}$ |
| Coupler X (see Table 2) | $6.0 \times 10^{-4}$ (mol/m$^2$) |
| Coupler Y (see Table 2) | $3.0 \times 10^{-5}$ (mol/m$^2$) |
| Coupler Z (see Table 2) | 0.020 |
| HBS-1 | 0.060 |
| Gelatin | 0.73 |
| Fourth Layer (Second Red Sensitive Emulsion Layer) | |
| Emulsion G as silver | 1.0 |
| Sensitizing Dye I | $5.1 \times 10^{-5}$ |
| Sensitizing Dye II | $1.4 \times 10^{-5}$ |
| Sensitizing Dye III | $2.3 \times 10^{-4}$ |
| Coupler X (see Table 2) | $7.0 \times 10^{-4}$ (mol/m$^2$) |
| Coupler Y (see Table 2) | $5.0 \times 10^{-5}$ (mol/m$^2$) |
| EX-3 | 0.020 |
| EX-4 | 0.030 |
| EX-10 | 0.015 |
| HBS-1 | 0.060 |
| Gelatin | 1.1 |
| Fifth Layer (Third Red Sensitive Emulsion Layer) | |
| Emulsion D as silver | 1.60 |
| Sensitizing Dye I | $5.4 \times 10^{-5}$ |
| Sensitizing Dye II | $1.4 \times 10^{-5}$ |
| Sensitizing Dye III | $2.4 \times 10^{-4}$ |
| EX-3 | 0.010 |
| EX-4 | 0.080 |
| EX-2 | 0.097 |
| HBS-1 | 0.22 |
| HBS-2 | 0.10 |
| Gelatin | 1.39 |
| Sixth Layer (Intermediate Layer) | |
| EX-5 | 0.040 |
| HBS-1 | 0.020 |
| Gelatin | 0.68 |
| Seventh Layer (First Green Sensitive Emulsion Layer) | |
| Emulsion A as silver | 0.15 |
| Emulsion B as silver | 0.15 |
| Sensitizing Dye V | $3.0 \times 10^{-5}$ |
| Sensitizing Dye VI | $1.0 \times 10^{-4}$ |
| Sensitizing Dye VII | $3.8 \times 10^{-4}$ |
| EX-6 | 0.260 |
| EX-1 | 0.021 |
| EX-7 | 0.030 |
| EX-8 | 0.025 |
| HBS-1 | 0.100 |
| HBS-3 | 0.010 |
| Gelatin | 0.53 |
| Eighth Layer (Second Green Sensitive Emulsion Layer) | |
| Emulsion C as silver | 0.45 |
| Sensitizing Dye V | $2.1 \times 10^{-5}$ |

-continued

| | |
|---|---|
| Sensitizing Dye VI | $7.0 \times 10^{-5}$ |
| Sensitizing Dye VII | $2.6 \times 10^{-4}$ |
| EX-6 | 0.094 |
| EX-8 | 0.018 |
| EX-7 | 0.026 |
| HBS-1 | 0.160 |
| HBS-3 | 0.008 |
| Gelatin | 0.43 |
| Ninth Layer (Third Green Sensitive Emulsion Layer) | |
| Emulsion E as silver | 1.2 |
| Sensitizing Dye V | $3.5 \times 10^{-5}$ |
| Sensitizing Dye VI | $8.0 \times 10^{-5}$ |
| Sensitizing Dye VII | $3.0 \times 10^{-4}$ |
| EX-13 | 0.015 |
| EX-14 | 0.015 |
| EX-11 | 0.100 |
| EX-1 | 0.025 |
| HBS-1 | 0.25 |
| HBS-2 | 0.10 |
| Gelatin | 1.31 |
| Tenth Layer (Yellow Filter Layer) | |
| Yellow Colloidal Silver as silver | 0.05 |
| EX-5 | 0.08 |
| HBS-1 | 0.03 |
| Gelatin | 0.81 |
| Eleventh Layer (First Blue Sensitive Emulsion Layer) | |
| Emulsion A as silver | 0.08 |
| Emulsion B as silver | 0.07 |
| Emulsion F as silver | 0.07 |
| Sensitizing Dye VIII | $3.5 \times 10^{-4}$ |
| EX-9 | 0.72 |
| EX-8 | 0.042 |
| HBS-1 | 0.28 |
| Gelatin | 0.94 |
| Twelfth Layer (Second Blue Sensitive Emulsion Layer) | |
| Emulsion G as silver | 0.45 |
| Sensitizing Dye VIII | $2.1 \times 10^{-4}$ |
| EX-9 | 0.154 |
| EX-10 | 0.007 |
| HBS-1 | 0.05 |
| Gelatin | 0.66 |
| Thirteenth Layer (Third Blue Sensitive Emulsion Layer) | |
| Emulsion H as silver | 0.77 |
| Sensitizing Dye VIII | $2.2 \times 10^{-4}$ |
| EX-15 | 0.20 |
| HBS-1 | 0.07 |
| Gelatin | 0.69 |
| Fourteenth Layer (First Protective Layer) | |
| Emulsion I as silver | 0.5 |
| U-4 | 0.11 |
| U-5 | 0.17 |
| HBS-1 | 0.05 |
| Gelatin | 0.85 |
| Fifteenth Layer (Second Protective Layer) | |
| Poly(methyl acrylate) Particles (diameter about 1.7 μm) | 0.54 |
| S-1 | 0.20 |
| Gelatin | 1.02 |

Gelatin Hardening Agent H-1 and sodium dodecylbenzenesulfonate as a surfactant were added to each layer in addition to the components indicated above. The amount of H-1 was about 2% based on the amount of gelatin in each layer, and that of sodium dodecylbenzenesulfonate was about 10% based on the amount of coupler.

| | Average AgI Content (%) | Mean Grain Size (μm) | Variation Coefficient of Grain Size (%) | Diameter/ Thickness Ratio | Silver Amount Ratio (AgI Content %) |
|---|---|---|---|---|---|
| Emulsion A | 4.1 | 0.45 | 27 | 1 | Core/Shell = 1/3 (13/1) Double Structure Grains |
| Emulsion B | 8.9 | 0.70 | 14 | 1 | Core/Shell = 3/7 (25/2) Double Structure Grains |
| Emulsion C | 10 | 0.75 | 30 | 2 | Core/Shell = 1/2 (24/3) Double Structure Grains |
| Emulsion D | 16 | 1.05 | 35 | 2 | Core/Shell = 1/2 (40/0) Double Structure Grains |
| Emulsion E | 10 | 1.05 | 35 | 3 | Core/Shell = 1/2 (24/3) Double Structure Grains |

-continued
| | Average AgI Content (%) | Mean Grain Size (μm) | Variation Coefficient of Grain Size (%) | Diameter/ Thickness Ratio | Silver Amount Ratio (AgI Content %) |
|---|---|---|---|---|---|
| Emulsion F | 4.1 | 0.25 | 28 | 1 | Core/Shell = 1/3 (13/1) Double Structure Grains |
| Emulsion G | 13.6 | 0.75 | 25 | 2 | Core/Shell = 1/2 (42/0) Double Structure Grains |
| Emulsion H | 14 | 1.30 | 25 | 3 | Core/Shell = 37/63 (34/3) Double Structure Grains |
| Emulsion I | 1 | 0.07 | 15 | 1 | Uniform Grains |
EX-1
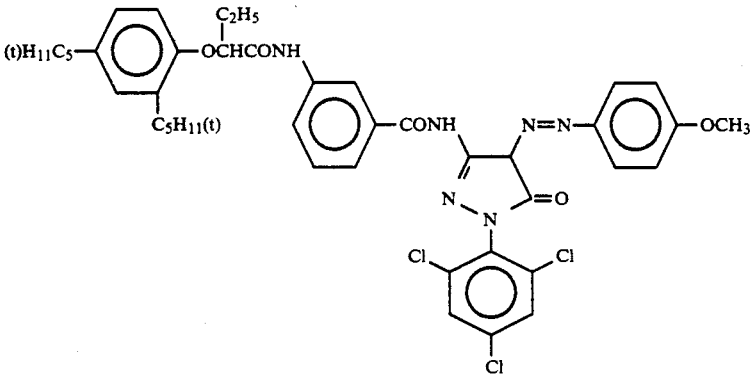
EX-2
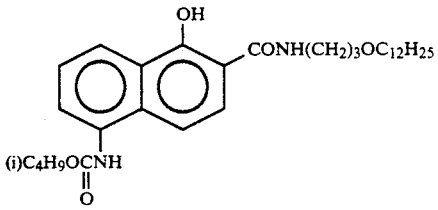
EX-3
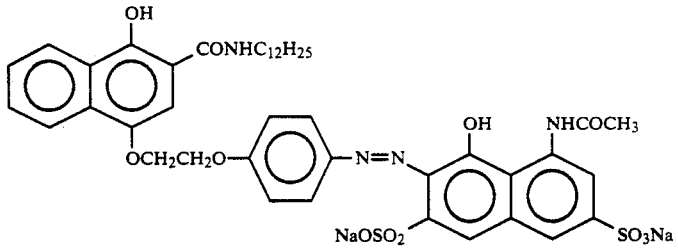
EX-4
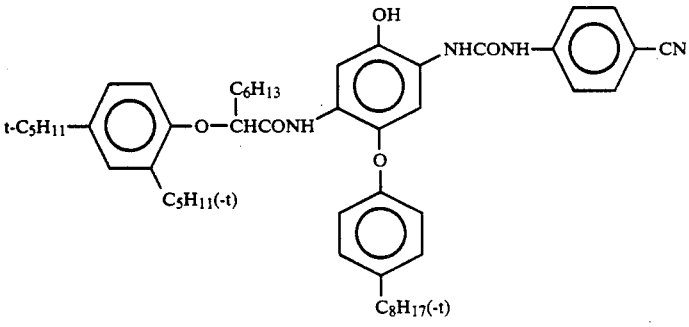
EX-5

-continued
| | Average AgI Content (%) | Mean Grain Size (μm) | Variation Coefficient of Grain Size (%) | Diameter/ Thickness Ratio | Silver Amount Ratio (AgI Content %) |
|---|---|---|---|---|---|
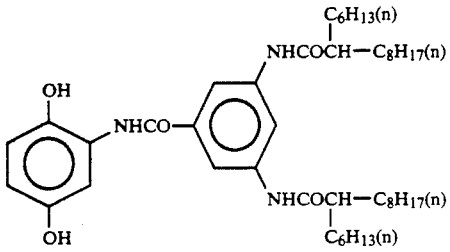
EX-6
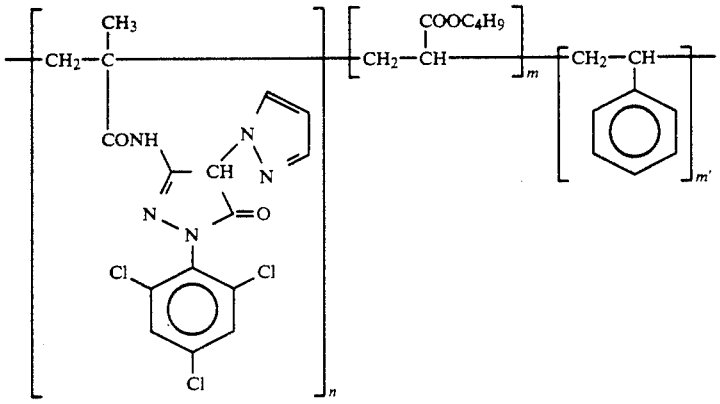
EX-7
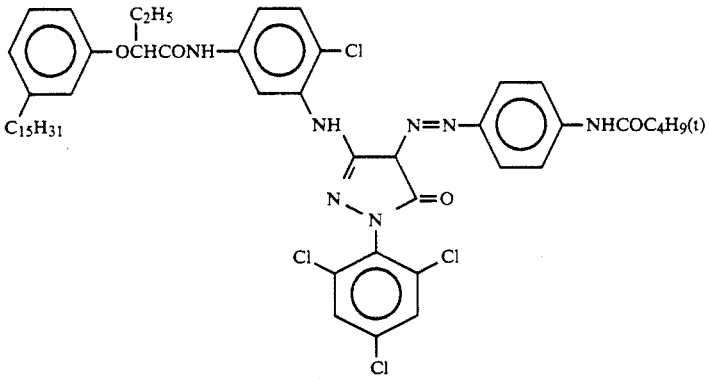
EX-8
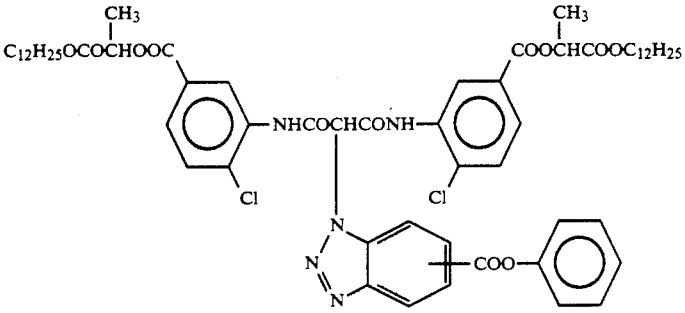
EX-9

-continued
| | Average AgI Content (%) | Mean Grain Size (μm) | Variation Coefficient of Grain Size (%) | Diameter/ Thickness Ratio | Silver Amount Ratio (AgI Content %) |
|---|---|---|---|---|---|
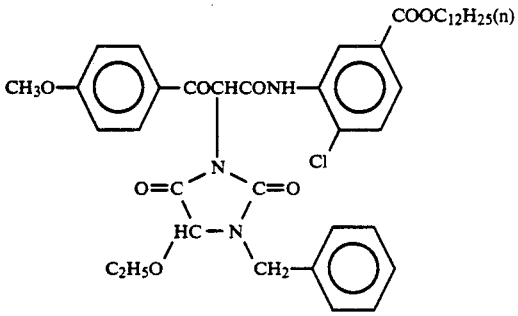
EX-10
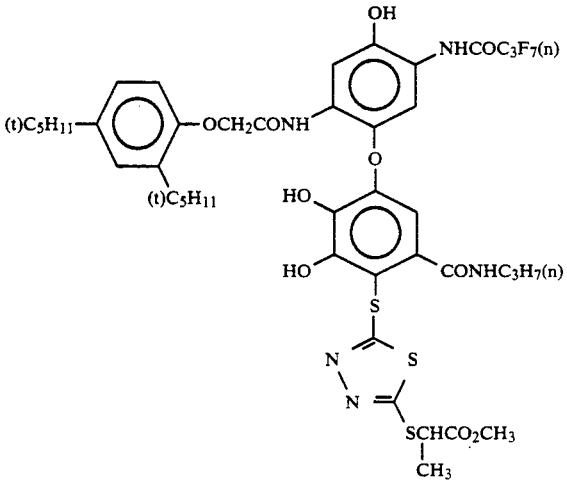
EX-11
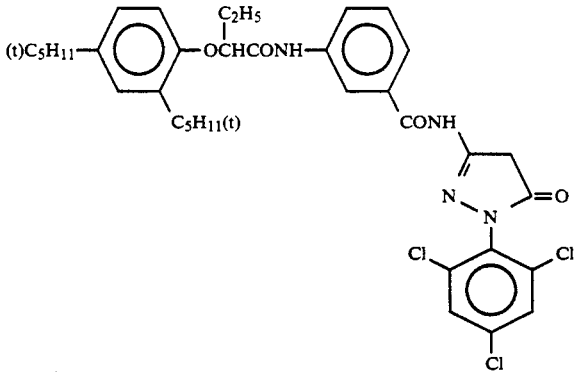
EX-12
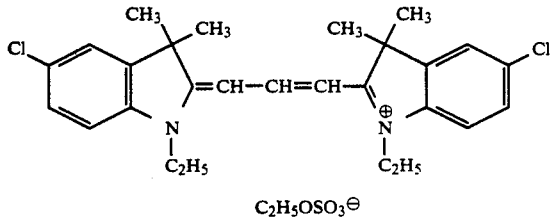
EX-13

-continued
| Average AgI Content (%) | Mean Grain Size (μm) | Variation Coefficient of Grain Size (%) | Diameter/ Thickness Ratio | Silver Amount Ratio (AgI Content %) |
|---|---|---|---|---|
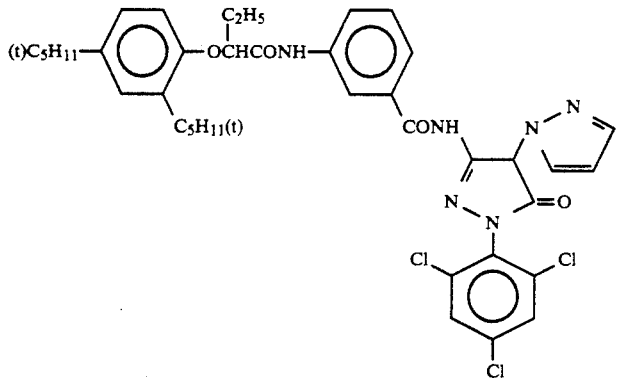
EX-14
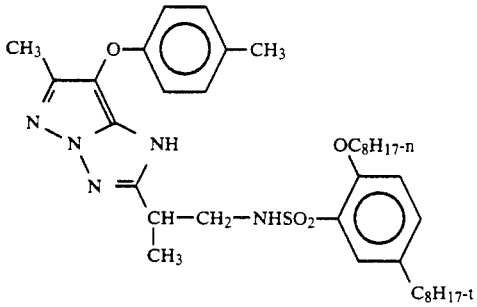
EX-15
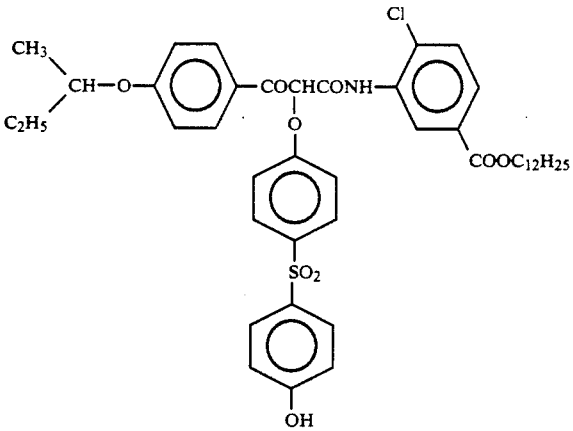
EX-16

-continued
| Average AgI Content (%) | Mean Grain Size (μm) | Variation Coefficient of Grain Size (%) | Diameter/ Thickness Ratio | Silver Amount Ratio (AgI Content %) |
|---|---|---|---|---|
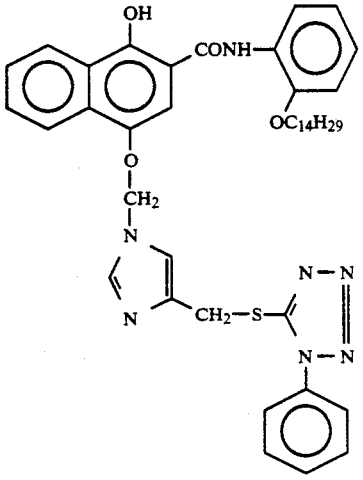
EX-17
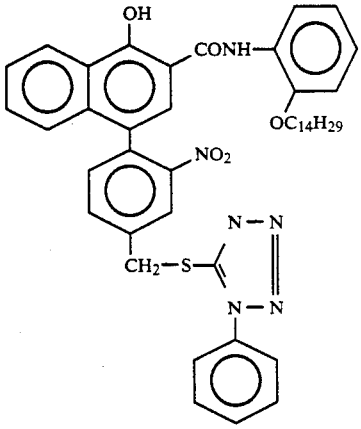
U-1
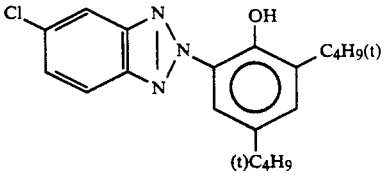
U-2
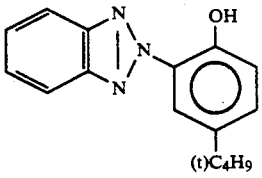
U-3
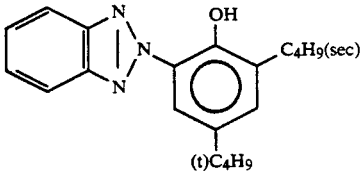

-continued
| | Average AgI Content (%) | Mean Grain Size (μm) | Variation Coefficient of Grain Size (%) | Diameter/ Thickness Ratio | Silver Amount Ratio (AgI Content %) |
|---|---|---|---|---|---|
U-4
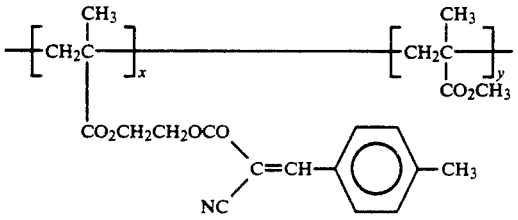
x:y = 70:30 (wt %)
UV-5
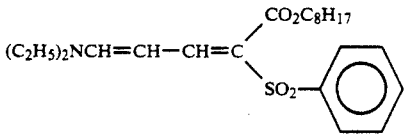
HBS-1
Tricresyl Phosphate
HBS-2
Di-n-butyl Phthalate
HBS-3
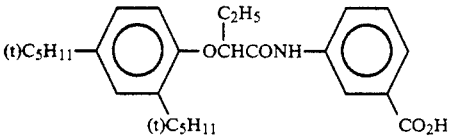
Sensitizing Dye I
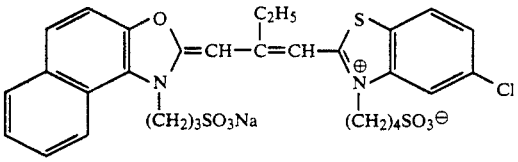
Sensitizing Dye II
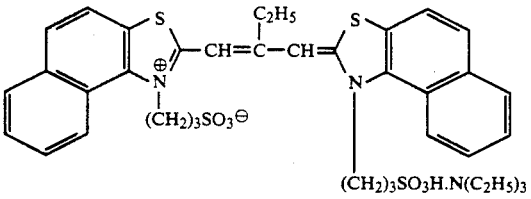
Sensitizing Dye III
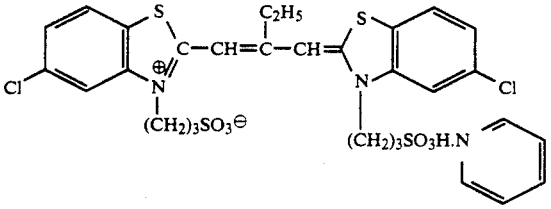
Sensitizing Dye V -continued

| Average AgI Content (%) | Mean Grain Size (μm) | Variation Coefficient of Grain Size (%) | Diameter/ Thickness Ratio | Silver Amount Ratio (AgI Content %) |
|---|---|---|---|---|

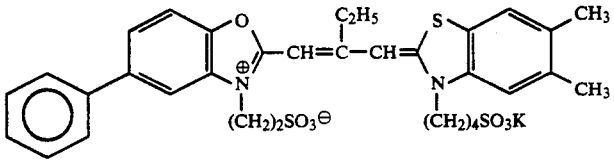

Sensitizing Dye VI

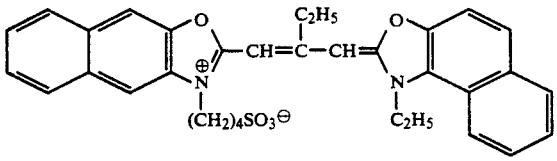

Sensitizing Dye VII

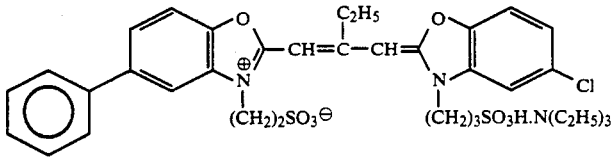

Sensitizing Dye VIII

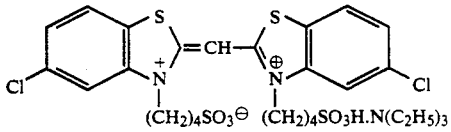

S-1

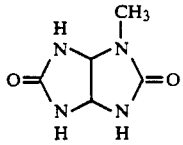

H-1

$CH_2{=}CH{-}SO_2CH_2{-}CONH{-}CH_2$ $CH_2{=}CH{-}SO_2CH_2{-}CONH{-}CH_2$

The overall dry thickness of the coated layer excluding the support and the support under-layer of Samples 201 to 215 prepared was from 16.5 μm to 17.4 μm.

Samples (201 to 215) prepared in this manner were cut and finished into strips of a width of 35 mm and then they were subjected to a wedge exposure with red light.

Next, the samples were processed in an automatic processor for motion picture film using the processing procedure outlined below. The samples for evaluation were processed after processing samples which had been subjected to an imagewise exposure to the extent that the amount of replenisher added to the color developer had reached three times the parent bath tank capacity.

| | Processing Operations | | | |
|---|---|---|---|---|
| Process | Processing Time | Processing Temp. | Replenishment Rate* | Tank Capacity |
| Color Development | 3 min. 15 sec. | 37.8° C. | 23 ml | 10 liters |
| Bleach | 40 seconds | 38.0° C. | 5 ml | 5 liters |
| Fix | 1 min. 30 sec. | 38.0° C. | 30 ml | 10 liters |
| Water Wash (1) | 30 seconds | 38.0° C. | — | 5 liters |
| Water Wash (2)** | 30 seconds | 38.0° C. | 30 ml | 5 liters |
| Stabilization | 30 seconds | 38.0° C. | 20 ml | 5 liters |

*Replenishment rate per meter of 35 mm wide material

**The water wash was a counter flow system from (2) to (1)

The compositions of the processing baths used are indicated below.

| | Parent Bath (grams) | Replenisher (grams) |
|---|---|---|
| **Color Development Bath** | | |
| Diethylenetriamine Pentaacetic Acid | 1.0 | 1.1 |
| 1-Hydroxyethylidene-1,1-diphosphonic Acid | 3.0 | 3.2 |
| Sodium Sulfite | 4.0 | 4.9 |
| Potassium Carbonate | 30.0 | 30.0 |
| Potassium Bromide | 1.4 | — |
| Potassium Iodide | 1.5 mg | — |
| Hydroxylamine Sulfate | 2.4 | 3.6 |
| 2-Methyl-4-[N-ethyl-N-(β-hydroxyethyl)amino]aniline Sulfate | 4.5 | 6.4 |
| Water to make up to | 1.0 liter | 1.0 liter |
| pH | 10.05 | 10.10 |
| **Bleach Bath** | | |
| 1,3-Diaminopropane Tetraacetic Acid, Ferric Ammonium Salt (mono-hydrate) | 144.0 | 206.0 |
| 1,3-Diaminopropane Tetraacetic Acid | 2.8 | 4.0 |
| Ammonium Bromide | 84.0 | 120.0 |
| Ammonium Nitrate | 30.0 | 41.7 |
| Acetic Acid (98% aq. soln.) | 50.0 | 72.5 |
| Water to make up to | 1.0 liter | 1.0 liter |
| pH (adjusted with aqueous ammonia (27%)) | 4.0 | 3.2 |
| **Fixer Bath Parent Bath = Replenisher (Units: Grams)** | | |
| Ethylene Diamine Tetraacetic Acid, Di-ammonium Salt | | 1.7 |
| Ammonium Sulfite | | 14.0 |
| Ammonium Thiosulfate (700 g/l aq. soln.) | | 340.0 ml |
| Water to make up to | | 1.0 liter |
| pH | | 7.0 |
| **Water Washing Water Parent Bath = Replenisher** | | |
| Town water was passed through a mixed bed type column packed with an H-type strongly acidic cation exchange resin ("Amberlite IR-120", made by the Rohm and Haas Co.) and an OH-type strongly basic anion exchange resin ("Amberlite IRA-400", made by Rohm and Haas Co.) and treated such that the calcium and magnesium ion concentrations were not more than 3 mg/ml, after which 20 mg/l of sodium isocyanurate dichloride and 150 mg/l of sodium sulfate were added. The pH of this solution was within the range from 6.5 to 7.5. | | |
| **Stabilizing Bath Parent Bath = Replenisher (Units: Grams)** | | |
| Formaldehyde (37% aq. soln.) | | 1.2 ml |
| Surfactant [$C_{10}H_{21}$—O(CH$_2$CH$_2$O)$_{10}$—H] | | 0.4 |
| Ethylene Glycol | | 1.0 |
| Water to make up to | | 1.0 liter |
| pH | | 5.0 to 7.0 |

The colored samples (Samples 201 to 215) obtained by development processing were subjected to red density measurements using a Fuji model densitometer. The density of each sample at the exposure required to provide a density of 1.0 for Sample 201 is shown in Table 2.

Furthermore, $\Delta\lambda_{max}$ values were obtained using the same method as described in Example 1. These results are also shown in Table 2.

TABLE 2

| Sample No. | Coupler X | Coupler Y | Coupler Z | Measured Density Value | $\Delta\lambda_{max}$ (nm) |
|---|---|---|---|---|---|
| 201 (Comparative Example) | A-1 | A-2 | EX-10 | 1.00 | 6 |
| 202 (Comparative Example) | B-1 | B-2 | EX-10 | 0.96 | 5 |
| 203 (This Invention) | I-1 | C-1 | EX-10 | 1.20 | 5 |
| 204 (This Invention) | I-1 | C-7 | EX-10 | 1.30 | 5 |
| 205 (This Invention) | I-1 | C-1 | EX-16 | 1.38 | 4 |
| 206 (This Invention) | I-1 | C-10 | EX-16 | 1.22 | 5 |
| 207 (This Invention) | I-5 | C-1 | EX-16 | 1.35 | 6 |
| 208 (This Invention) | I-5 | C-7 | EX-16 | 1.29 | 6 |
| 209 (This Invention) | I-8 | C-14 | EX-17 | 1.25 | 5 |
| 210 (This Invention) | I-10 | C-24 | EX-17 | 1.26 | 6 |
| 211 (This Invention) | I-12 | C-1 | EX-17 | 1.33 | 5 |
| 212 (This Invention) | I-13 | C-7 | B-1 | 1.28 | 4 |
| 213 (This Invention) | I-14 | C-10 | B-1 | 1.27 | 4 |
| 214 (This Invention) | I-19 | C-25 | B-1 | 1.21 | 6 |
| 215 (This Invention) | I-20 | C-1 | B-1 | 1.21 | 5 |

It is clear from the results shown in Table 2 that even with multi-layer photosensitive materials, the present invention provides good color forming properties and there is little change in hue as the density changes.

As is clear from the results described above, photosensitive materials which have a high coupling reactivity and a high maximum color density, and where the change is hue due to differences in color density is little, can be obtained by means of the present invention.

While the invention has been described in detail and with reference to specific embodiments thereof, it will be apparent to one skilled in the art that various changes and modifications can be made therein without departing from the spirit and scope thereof.

What is claimed is:

1. The silver halide color photographic photosensitive material comprising a support having thereon at least one silver halide emulsion layer, wherein at least one cyan dye forming coupler represented by the formula (I) indicated below

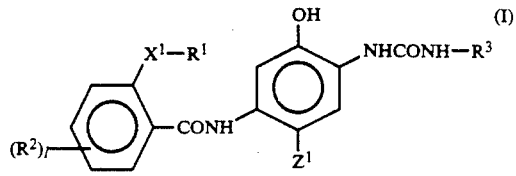

wherein $R^1$ represents a substituted or unsubstituted alkyl group, alkenyl group, alkynyl group, cycloalkyl group or aryl group; $X^1$ represents a single bond, —O—, —S—, —SO—, $SO_2$, —COO—, $$-\underset{\underset{R^6}{|}}{CON}-,\ -SO_2O-,\ -\underset{\underset{R^6}{|}}{SO_2N}-\ \text{or}\ -\underset{\underset{R^7}{|}}{N}-;$$

wherein $R^6$ represents a hydrogen atom, an acyl group having 1 to 36 carbon atoms or a group with the same meaning as $R^1$; $R^7$ is a hydrogen atom or a linear, branched chain or substituted alkyl group;

$R^2$ represents a group which can be substituted on a benzene ring; l represents an integer of 0 to 4; $R^3$ represents a substituted or unsubstituted aryl group; and $Z^1$ represents a hydrogen atom or a coupling-off group and at least one cyan dye forming coupler which can be represented by the formula (C) indicated below

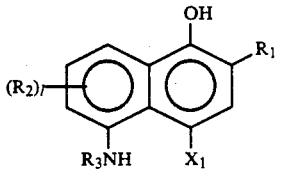

(C)

wherein $R_1$ represents —$CONR_4R_5$, —$SO_2NR_4R_5$, —$NHCOR_4$, —$NHCOOR_6$, —$NHSO_2R_6$, —$NHCONR_4R_5$ or —$NHSO_2NR_4R_5$; $R_2$ represents a group which can be substituted on a naphthalene ring; l represents an integer of 0 to 3; $R_3$ represents a substituent group; $X_1$ represents a coupling-off group; $R_4$ and $R_5$, which may be the same or different, each represents a hydrogen atom, an alkyl group, an aryl group or a heterocyclic group; and $R_6$ represents an alkyl group, an aryl group or a heterocyclic group; and when l is 2 or 3, the $R_2$ groups may be the same or different, or they may combine and form a ring; $R_2$ and $R_3$, or $R_3$ and $X_1$, may combine and form a ring; and dimers or larger oligomers formed by joining together via di- or higher valent groups at $R_1$, $R_2$, $R_3$ or $X_1$, are present in the same layer or in a different layer.

2. The silver halide color photographic photosensitive material of claim 1, wherein the coupler of the formula (I) and the coupler of the formula (C) are present in a silver halide emulsion layer.

3. The silver halide color photographic photosensitive material of claim 1, wherein the coupler of the formula (I) and the coupler of the formula (C) are present in a red sensitive silver halide emulsion layer.

4. The silver halide color photographic photosensitive material of claim 1, wherein the coupler of the formula (I) is present in a different layer from the layer in which the coupler of the formula (C) is present.

5. The silver halide color photographic photosensitive material of claim 1, wherein the proportion of the coupler of the formula (I) is at least 50 mol % of the total amount of the coupler of the formula (I) and of the coupler of the formula (C).

6. The silver halide color photographic photosensitive material of claim 1, wherein the proportion of the coupler of the formula (I) is at least 90 mol % of the total amount of the coupler of the formula (I) and of the coupler of the formula (C).

7. The silver halide color photographic photosensitive material of claim 1, wherein the amount of the coupler of the formula (I) and of the coupler of the formula (C) is 0.002 to 2 mol per mol of photosensitive silver halide.

8. The silver halide color photographic photosensitive material of claim 1, wherein the silver halide of the silver halide emulsion layer is silver iodobromide, silver bromide, silver chlorobromide or silver chloride.

9. The silver halide color photographic photosensitive material of claim 1, wherein the photosensitive material contains additionally at least one of a magenta coupler and a yellow coupler.

10. The silver halide color photographic photosensitive material of claim 1, wherein the photosensitive material is a color paper, a color reversal paper, a color positive film, a color negative film, a color reversal film or a color direct positive film.

11. The silver halide color photographic photosensitive material of claim 1, wherein the photosensitive material is a color negative film.

12. The silver halide color photographic photosensitive material of claim 1, wherein the coupler of formulas (I) and (C) are present in the same layer.

13. The silver halide color photographic photosensitive material of claim 1, wherein in formula (I), $R_1$ represents a linear chain or branched chain alkyl group which has a total number of carbon atoms of from 1 to 36, a linear chain or branched chain alkenyl of C number from 2 to 36, a linear chain or branched chain alkynyl group of C from 2 to 36, a three to twelve membered cycloalkyl group of C number from 1 to 36 or an aryl group of C number from 6 to 36, and these groups may be substituted.

14. The silver halide color photographic photosensitive material of claim 1, wherein $R^2$ is a halogen atom, an alkyl group having from 1 to 24 carbon atoms, a cycloalkyl group having from 3 to 24 carbon atoms, an alkoxy group having from 1 to 24 carbon atoms, a carbonamido group having from 2 to 24 carbon atoms, or a sulfonamido group having from 1 to 24 carbon atoms.

15. The silver halide color photographic photosensitive material of claim 1, wherein l is an integer of from 0 to 2.

16. The silver halide color photographic photosensitive material of claim 1, wherein $R^3$ in formula (I) is an aryl group having from 6 to 36 carbon atoms.

17. The silver halide color photographic photosensitive material of claim 1, wherein $R^4$, $R^5$ and $R^6$ in formula (C) each independently represents an alkyl group which has a total number of carbon atoms of from 1 to 30, an aryl group having from 6 to 30 carbon atoms, or a heterocyclic group having from 2 to 30 carbon atoms.

18. The silver halide color photographic photosensitive material of claim 1, wherein $R_2$ is selected from the group consisting of halogen atoms, hydroxyl groups, carboxyl groups, amino groups, sulfo groups, cyano groups, alkyl groups, aryl groups, heterocyclic groups, carbonamido groups, sulfonamido groups, carbamoyl groups, sulfamoyl groups, ureido groups, acyl groups, acyloxy groups, alkoxy groups, aryloxy groups, alkylthio groups, arylthio groups, alkylsulfonyl groups, arylsulfonyl groups, sulfamoylamino groups, alkoxycarbonylamino groups, nitro groups and imido groups.

* * * * *